US009806428B2

(12) United States Patent
Haluba et al.

(10) Patent No.: US 9,806,428 B2
(45) Date of Patent: Oct. 31, 2017

(54) SYSTEMS AND METHODS FOR FORMING, DIRECTING, AND NARROWING COMMUNICATION BEAMS

(71) Applicant: Siklu Communication Ltd., Petah Tikva (IL)

(72) Inventors: Ovadia Haluba, Raanana (IL); Naftali Chayat, Kfar Saba (IL); Yigal Leiba, Holon (IL); Itzik Ben Bassat, Kiryat Ono (IL); Boris Maysel, Rehovot (IL)

(73) Assignee: Siklu Communication Ltd., Petach-Tivka (IL)

( * ) Notice: Subject to any disclaimer, the term of this patent is extended or adjusted under 35 U.S.C. 154(b) by 686 days.

(21) Appl. No.: 14/310,017

(22) Filed: Jun. 20, 2014

(65) Prior Publication Data

US 2014/0368385 A1 Dec. 18, 2014

Related U.S. Application Data

(63) Continuation-in-part of application No. 13/918,978, filed on Jun. 16, 2013, now Pat. No. 8,413,078.

(60) Provisional application No. 61/873,395, filed on Sep. 4, 2013.

(51) Int. Cl.

| | |
|---|---|
| ***H01Q 3/02*** | (2006.01) |
| ***H01Q 3/00*** | (2006.01) |
| ***H01Q 19/06*** | (2006.01) |
| ***H01Q 25/00*** | (2006.01) |

(52) U.S. Cl.
CPC ..... *H01Q 19/062* (2013.01); *H01Q 25/002* (2013.01); *H01Q 25/007* (2013.01)

(58) Field of Classification Search
CPC ..... H04W 16/28; H04B 7/10
USPC ..... 342/81, 154, 367, 373, 374, 372; 343/761, 779, 781 P
See application file for complete search history.

(56) References Cited

U.S. PATENT DOCUMENTS

| | | | |
|---|---|---|---|
| 3,604,009 | A | 9/1971 | Behnke |
| 3,914,768 | A | 10/1975 | Ohm |
| 4,115,782 | A | 9/1978 | Han et al. |
| 4,929,956 | A | 5/1990 | Lee et al. |
| 4,933,682 | A | 6/1990 | Vaughan |
| 5,360,973 | A | 11/1994 | Webb |
| 6,169,910 | B1 | 1/2001 | Tamil et al. |
| 6,262,689 | B1 | 7/2001 | Yamamoto et al. |
| 6,522,437 | B2 | 2/2003 | Presley et al. |
| 6,650,281 | B2 | 11/2003 | Caille et al. |

(Continued)

OTHER PUBLICATIONS

International search report of PCT/IL2014/050420, dated Nov. 6, 2014.

(Continued)

*Primary Examiner* — Dao Phan
(74) *Attorney, Agent, or Firm* — Active Knowledge Ltd.

(57) ABSTRACT

Various embodiments of a communication system operative to form, direct, and narrow communication beams using an array of electromagnetic radiators and a beam-narrowing architecture. A beam-width of an electromagnetic beam is narrowed, thereby increasing the concentration of electromagnetic energy in the beam and achieving a significant antenna gain. In various embodiments, the direction of an electromagnetic beam may be altered to improve communication between a transmitter and a receiver. In various embodiments, the system is a millimeter-wave system with a millimeter-wave array and millimeter-wave beams.

20 Claims, 21 Drawing Sheets

(56) References Cited

U.S. PATENT DOCUMENTS

| | | | |
|---|---|---|---|
| 7,006,053 | B2 | 2/2006 | Zigler et al. |
| 7,119,758 | B2 | 10/2006 | Louzir et al. |
| 7,233,299 | B2 | 6/2007 | Thevenot et al. |
| 7,432,846 | B2 | 10/2008 | Martin et al. |
| 7,800,549 | B2 | 9/2010 | Rebeiz et al. |
| 8,193,994 | B2 | 6/2012 | Alamouti et al. |
| 2002/0105476 | A1 | 8/2002 | Overton |
| 2002/0164946 | A1 | 11/2002 | Olsen et al. |
| 2006/0068719 | A1 | 3/2006 | Hairapetian |
| 2009/0027268 | A1 | 1/2009 | Coward |
| 2010/0214150 | A1 | 8/2010 | Lovberg et al. |
| 2012/0076217 | A1 | 3/2012 | Kirshenbaum et al. |
| 2012/0146827 | A1 | 6/2012 | Reitmeier et al. |
| 2012/0256796 | A1 | 10/2012 | Leiba |
| 2014/0227966 | A1 | 8/2014 | Artemenko et al. |

OTHER PUBLICATIONS

Written opinion of international searching authority of PCT/IL2014/050420, dated Nov. 6, 2014.

SYSTEMS AND METHODS FOR FORMING, DIRECTING, AND NARROWING COMMUNICATION BEAMS

CROSS REFERENCE TO RELATED APPLICATIONS

The present application claims priority under 35 USC §120 to U.S. Provisional Application No. 61/873,395 filed on Sep. 4, 2013. The present application is a CIP of U.S. application Ser. No. 13/918,978 filed Jun. 16, 2013.

BACKGROUND

In electromagnetic communication systems, a higher gain of an antenna is associated with greater distance, superior quality, and/or increased communication throughput. Various approaches are used to increase antenna gain, but the fundamental principle is to narrow the width of the beam of the transmission, such that relatively more energy is concentrated in a relatively smaller space. As the width of the beam narrows, directing the beam toward a desired target becomes increasingly difficult.

SUMMARY

Described herein are systems and methods for forming and directing communication beams in wireless communication networks, wherein the beam-width of a directed communication beam is reduced in order to focus the electro-magnetic energy, thereby increasing associated antenna gain.

One embodiment is a communication system that operates to direct the electromagnetic beams of transmissions such that relatively more electromagnetic energy is concentrated in a relatively smaller space. In one particular form of such an embodiment, the system includes an array of electromagnetic radiators which is operative to generate, toward a configurable direction, a first electromagnetic beam having a first beam-width and consequently associated with a first antenna gain. Such embodiment includes also a beam-narrowing architecture, which is operative to narrow the first electromagnetic beam and consequently convert this first electromagnetic beam into a second electromagnetic beam having a second beam-width that is narrower than the first beam-width. The result is that the second electromagnetic beam has (i) an association with a second antenna gain that is higher than the first antenna gain and (ii) a final bearing that is consequent upon said configurable direction. Also in this embodiment, the system is operative to control the final bearing via the configurable direction.

One embodiment is a method for accurately controlling the bearings of electromagnetic beams in a communication system. In some embodiments, (i) an array of electromagnetic radiators, generates a first electromagnetic beam toward a first direction, (ii) a beam-narrowing architecture narrows the first electromagnetic beam, resulting in a second electromagnetic beam that has a bearing consequent upon the first direction and (iii) the array of electromagnetic radiators changes the direction of the first electromagnetic beam from the first direction to a second direction, thereby altering the direction of the second electromagnetic beam from the first bearing to a new bearing that is consequent upon the second direction. Further, as a result of the method embodiment just described, a first angular difference between the first direction and the second direction is substantially larger than a second angular difference between the first bearing and the new bearing, and this change in angular differences facilitates accurate control over the new bearing.

BRIEF DESCRIPTION OF THE DRAWINGS

The embodiments are herein described, by way of example only, with reference to the accompanying drawings. No attempt is made to show structural details of the embodiments in more detail than is necessary for a fundamental understanding of the embodiments. In the drawings.

DETAILED DESCRIPTION

In this description, "close proximity" or "close" means (i) that an RFIC and an antenna suited physically close to one another, to within at most 5 wavelengths of a millimeter-wave signal generated by the RFIC and (ii) at the same time, this particular RFIC and this particular antenna are connected either by direct connection, or by a transmission line, or by wire bonding, or by some other structure that allows efficient transport of the millimeter-wave signal between the two.

In this description communication between a transmitter and a receiver has been "disrupted" when the signal to noise ratio between the two has fallen to a level which is too low to support previously used modulation and coding schemes, due to one or more of a number of causes, including physical movement of the transmitter, physical movement of the receiver, physical movement of both the transmitter and the receiver, physical movement of other components of the system, other physical obstacles, or other radio frequency interference ("RFI").

In this description, to say that "radiating sources are on the focal surface" means that a millimeter-wave focusing element has a focal surface, and each radiating source is located either on that surface or directly behind it.

In this description, there are various embodiments in which an original or first electromagnetic beam is altered to become a second or a final electromagnetic beam, which there is no middle stage between an original beam and a final beam. This alteration is called a "conversion" of the original beam, and the original beam has been "converted" into the final beam.

In this description, there are various embodiments in which a first or an original electromagnetic beam is altered to become an intermediate beam, and the intermediate beam is then altered to become a second or final beam. The alteration from an original beam to an intermediate beam is called a "translation" of the original beam, and the original beam has been "translated" into the intermediate beam. The alteration from an intermediate beam to a final beam is a "modification" of the intermediate beam, and the intermediate beam has been "modified" into the final beam.

In this description, an initial beam generated by electromagnetic radiators is a "first beam" or an "original beam", where these terms are equivalent.

In this description, after a first beam has been converted, the resulting beam is a "final beam", or a "second beam", or a "consequent beam", where these terms are equivalent.

In this description, after a first beam has been translated, the resulting beam is an "intermediate beam", which itself will be modified to become a final beam.

In this description, the "bearing of an electromagnetic beam" is the direction of the beam.

FIGS. 1A, 1B, 1C, 2A, 2B, 3A, and 3B, inclusive, illustrate various embodiments of radiating sources in a millimeter-wave point-to-point or point-to-multipoint communication system.

Figure 1A:
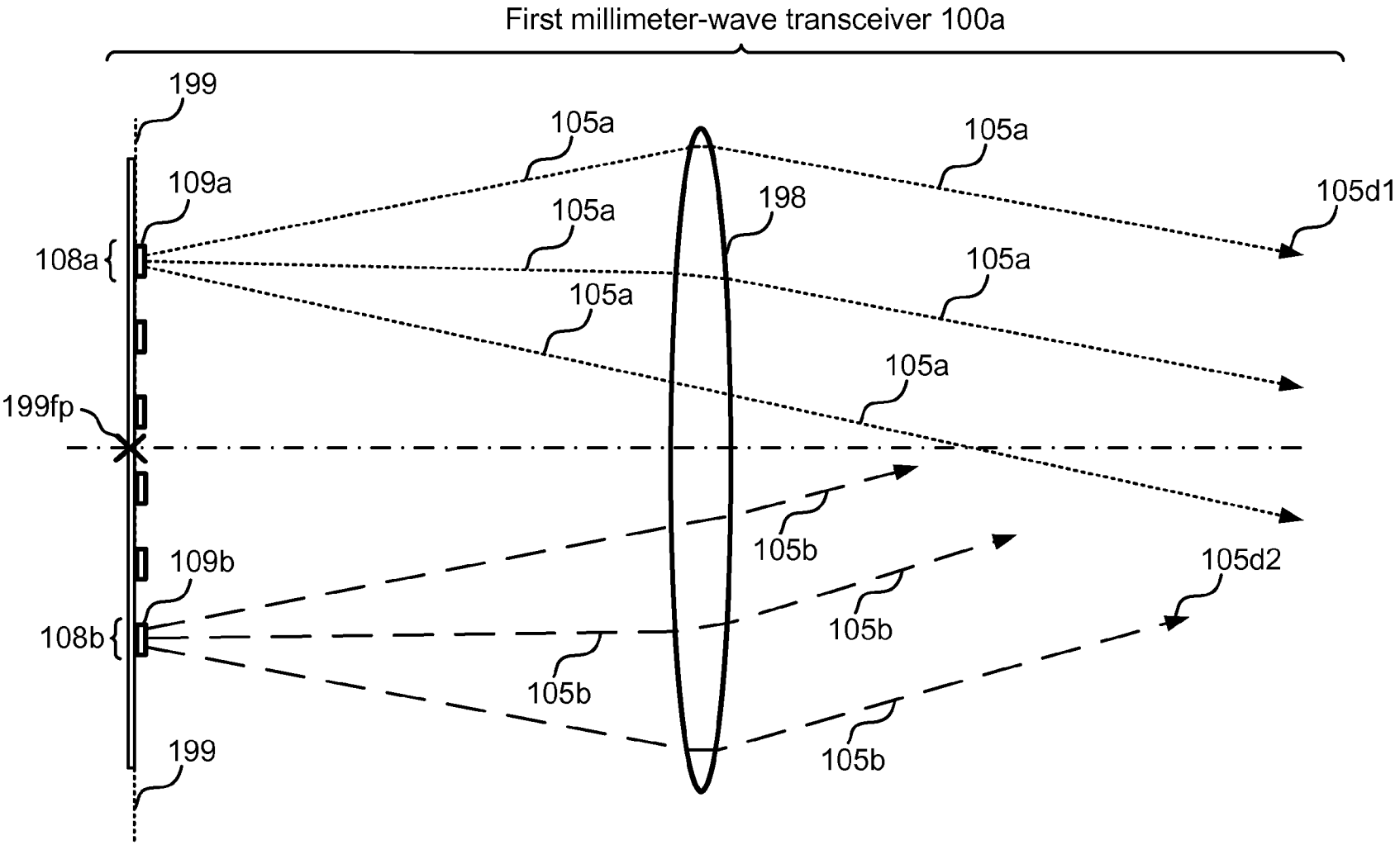
FIG. 1A illustrates one embodiment of radiating sources, placed as part of a first millimeter-wave transceiver with a millimeter-wave focusing element.

FIG. 1A illustrates one embodiment of radiating sources, placed as part of a first millimeter-wave transceiver with a millimeter-wave focusing element. A first millimeter-wave transceiver 100*a* is illustrated, which is one part of a point-to-point or point-to-multipoint millimeter-wave communication system, as shown in element 100*a* of FIG. 3A. At least two radiating sources, probably antennas coupled to RF signal sources, wherein said antennas may be printed antennas, and the radiating sources are located on the focal surface 199 of the system. In FIG. 1A, six such sources are illustrated, but only 109*a* and 109*b* are numbered. As described above, in alternative embodiments, there may be two sources only, or any number greater than two radiating sources. Radiating sources 109*a* and 109*b* are located on the focal surface 199 at locations 108*a* and 108*b*, respectively. The radiating sources radiate millimeter-wave beams, shown in an exemplary manner as first millimeter-wave beam 105*a* directed to millimeter-wave focusing element 198 toward first direction 105*d*1, and as second millimeter-wave beam 105*b* directed to millimeter-wave focusing element 198 toward second direction 105*d*2. It is noted that three rays are illustrated per each millimeter-wave beam for illustration purposes only.

Figure 3A:
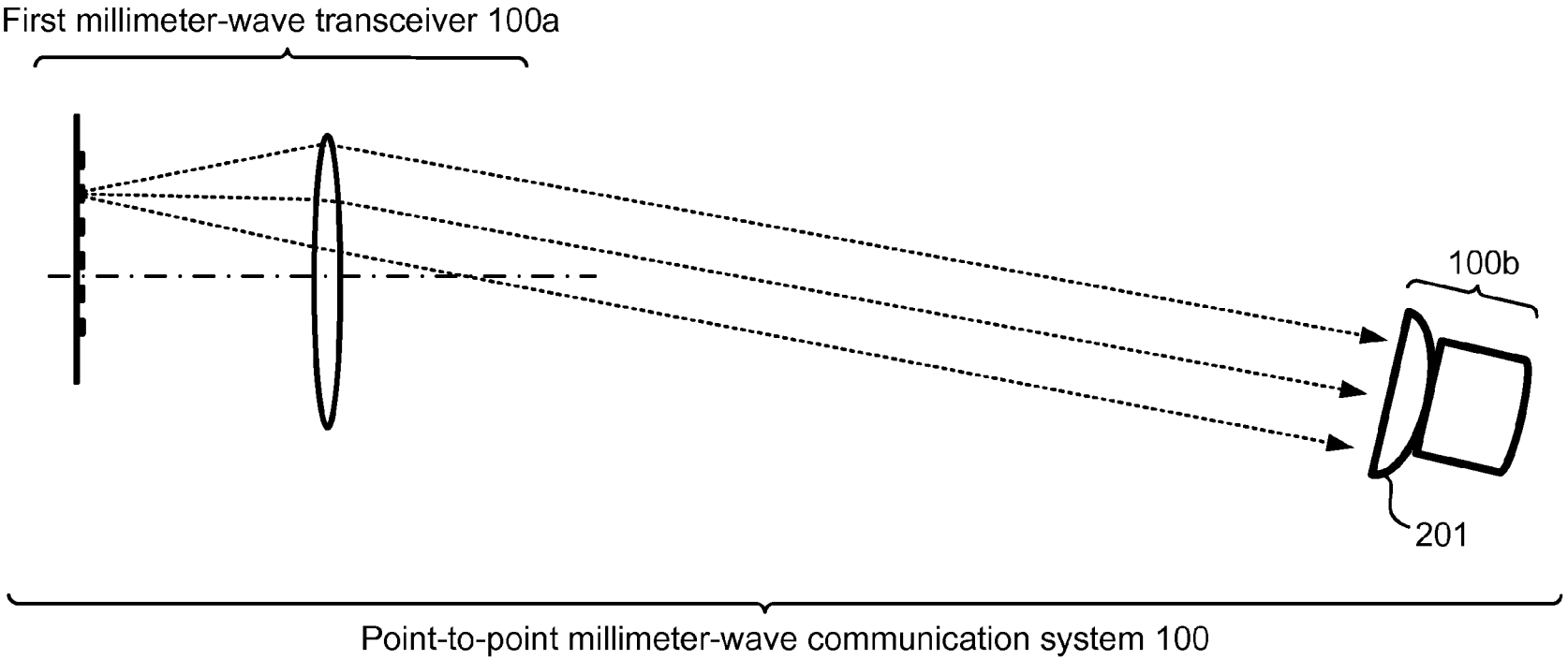
FIG. 3A illustrates one embodiment of a point-to-point millimeter-wave communication system, in which there is communication between a transmitter and a receiver.
Figure 3B:
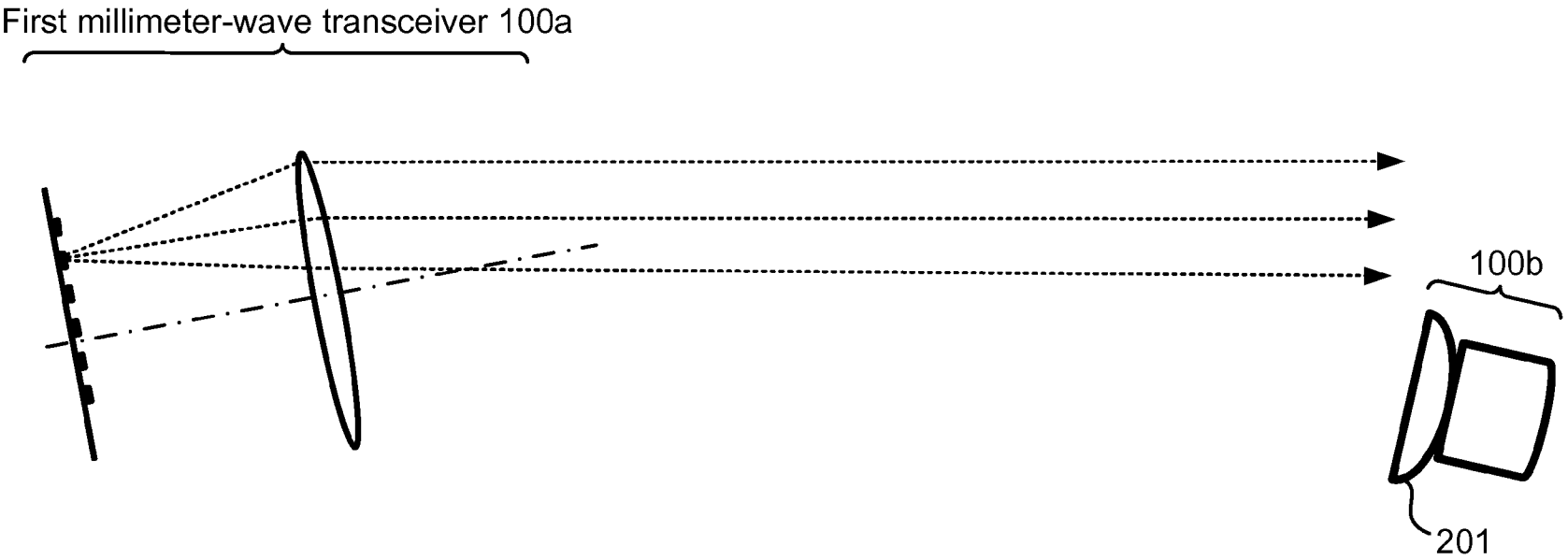
FIG. 3B illustrates one embodiment of a point-to-point millimeter-wave communication system, in which communication between a transmitter and a receiver has been disrupted.
Figure 3C:
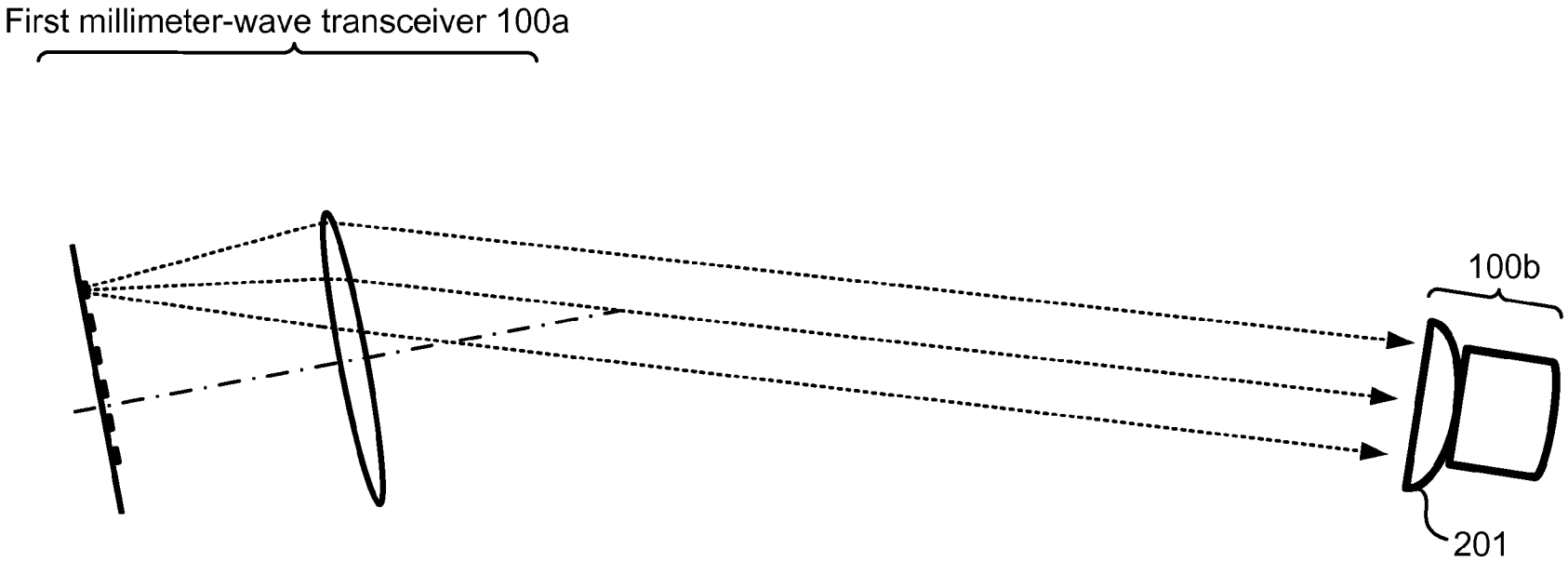
FIG. 3C illustrates one embodiment of a point-to-point millimeter-wave communication system, in which communication between a transmitter and a receiver has been restored.

It will be understood that the system illustrated in FIG. 1A is a lens 198 system, in which millimeter-wave beams travel through the lens 198 toward a location on the opposite side of the lens 198 from the focal surface 199. However, the system would operate in the same manner if element 198 were a concave or parabolic reflector designed so that the millimeter-waves reflect off the reflector toward a location on the same side of the reflector as the focal surface 199; this configuration is illustrated in FIG. 1E, in which millimeter-wave focusing element 198 is a reflector. Thus, in all the embodiments, element 198 may be a lens or a reflector. In FIGS. 3A, 3B, and 3C, the element is shown as a lens, but it could also function as a reflector, in which case the millimeter-wave beams would bounce back from the reflector toward the focal surface. Each radiating source includes at least an RF signal source (such as RFIC) and at least an antenna, such that the distance between these components is very small, which means that the radio frequency ("RF") signal loss from the RFIC to the antenna is very small, which requires, in one embodiment, a distance of at most 5 wavelengths, and in another embodiment a distance of at most 10 wavelengths.

Figure 1B:
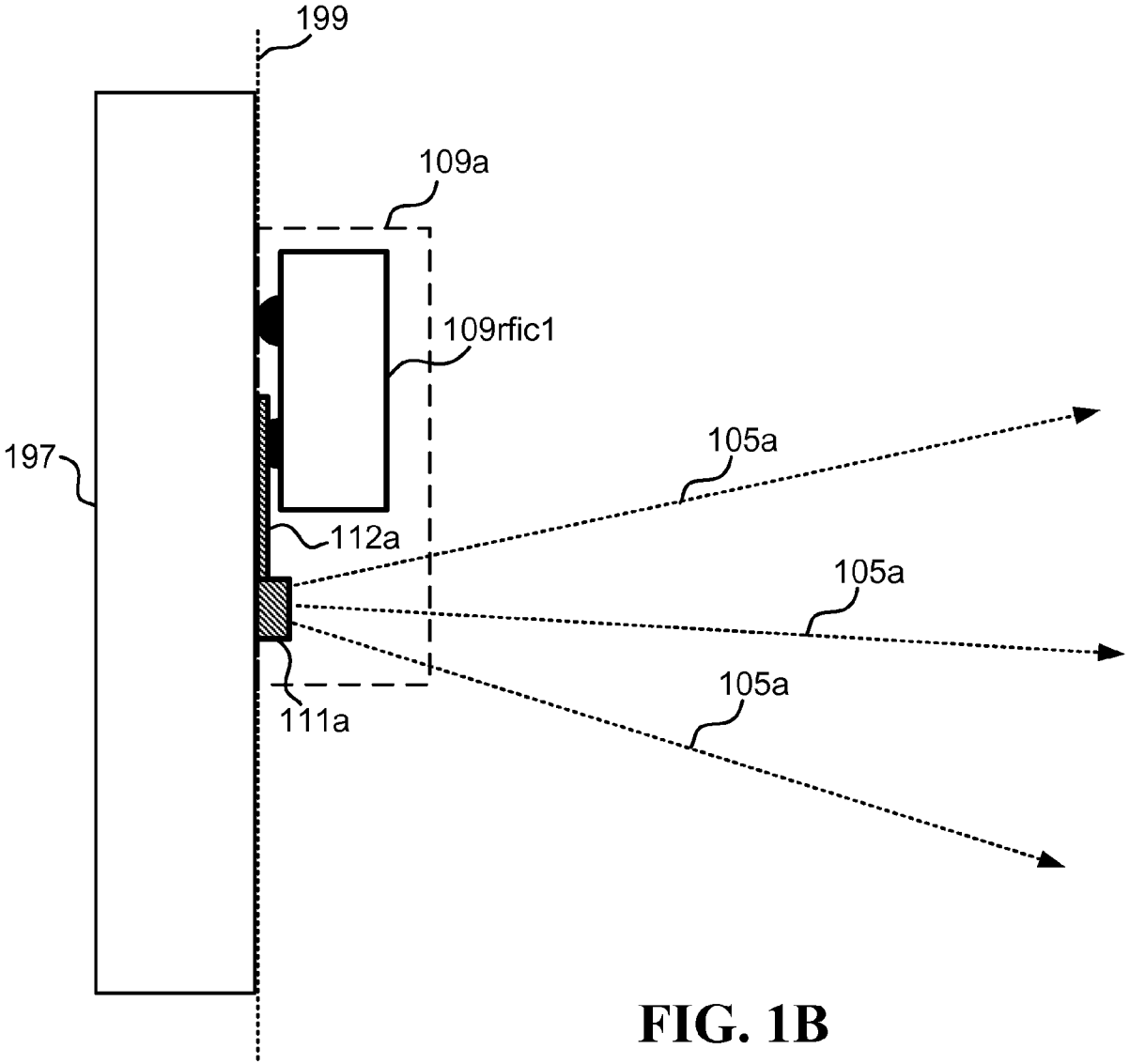
FIG. 1B illustrates one embodiment of a radiating source in a millimeter-wave communication system.

FIG. 1B illustrates one embodiment of a radiating source in a millimeter-wave communication system. In FIG. 1B, the radiating source 109*a* is mounted on a PCB 197, which is located on the focal surface 199. An RFIC 109*rfic*1 generates a millimeter-wave signal, which is conveyed via a transmission line 112*a* printed on the PCB 197 to an antenna 111*a*, which then transmits a millimeter-wave beam 105*a*.

Figure 1C:
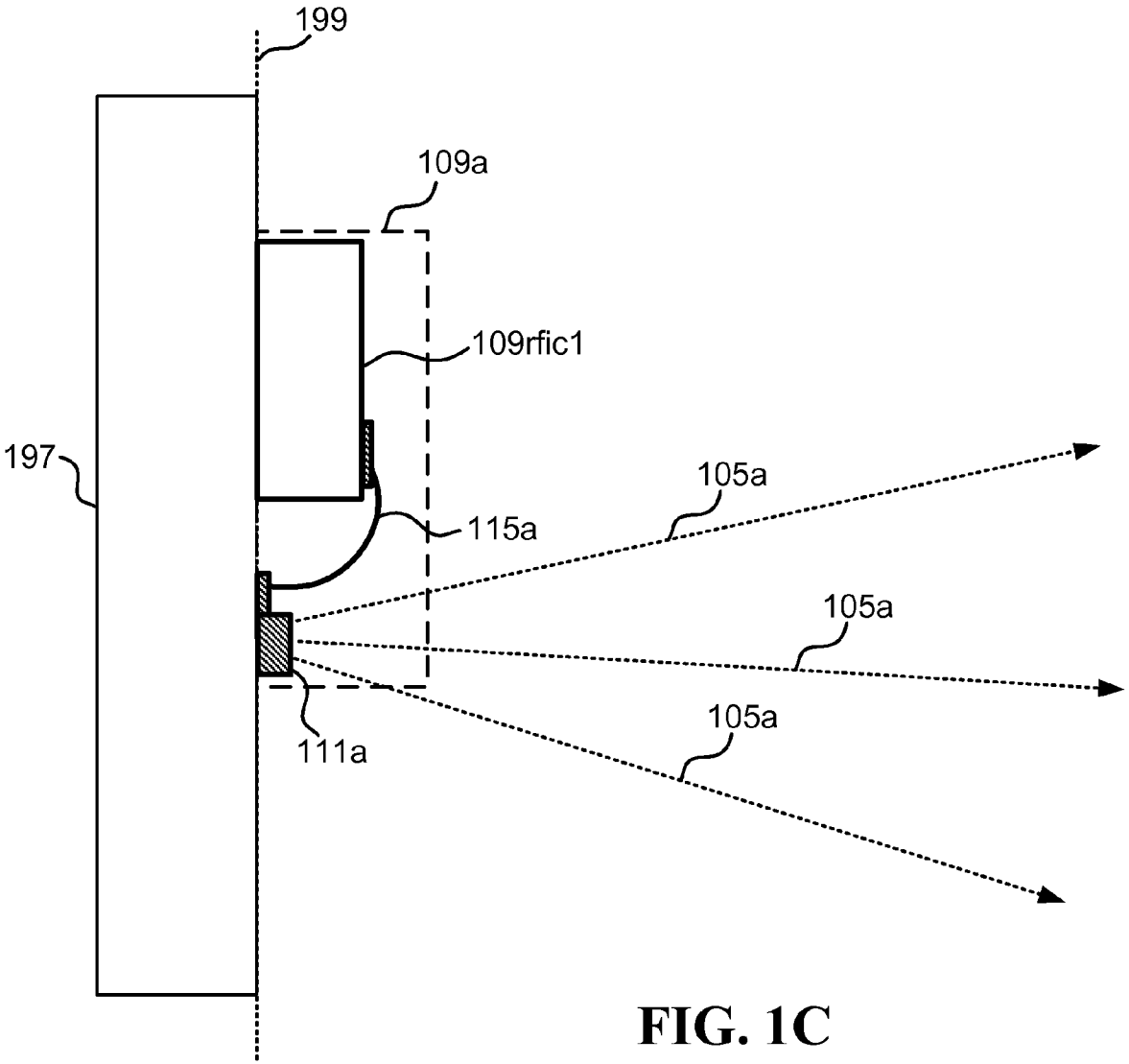
FIG. 1C illustrates one embodiment of a radiating source in a millimeter-wave communication system.

FIG. 1C illustrates an alternative embodiment of a radiating source in a millimeter-wave communication system. Instead of a transmission line 112*a* as illustrated in FIG. 1B, there is instead a wire bonding connection 115*a* that connects the RFIC 109*rfic*1 to the antenna 111*a*.

Figure 1D:
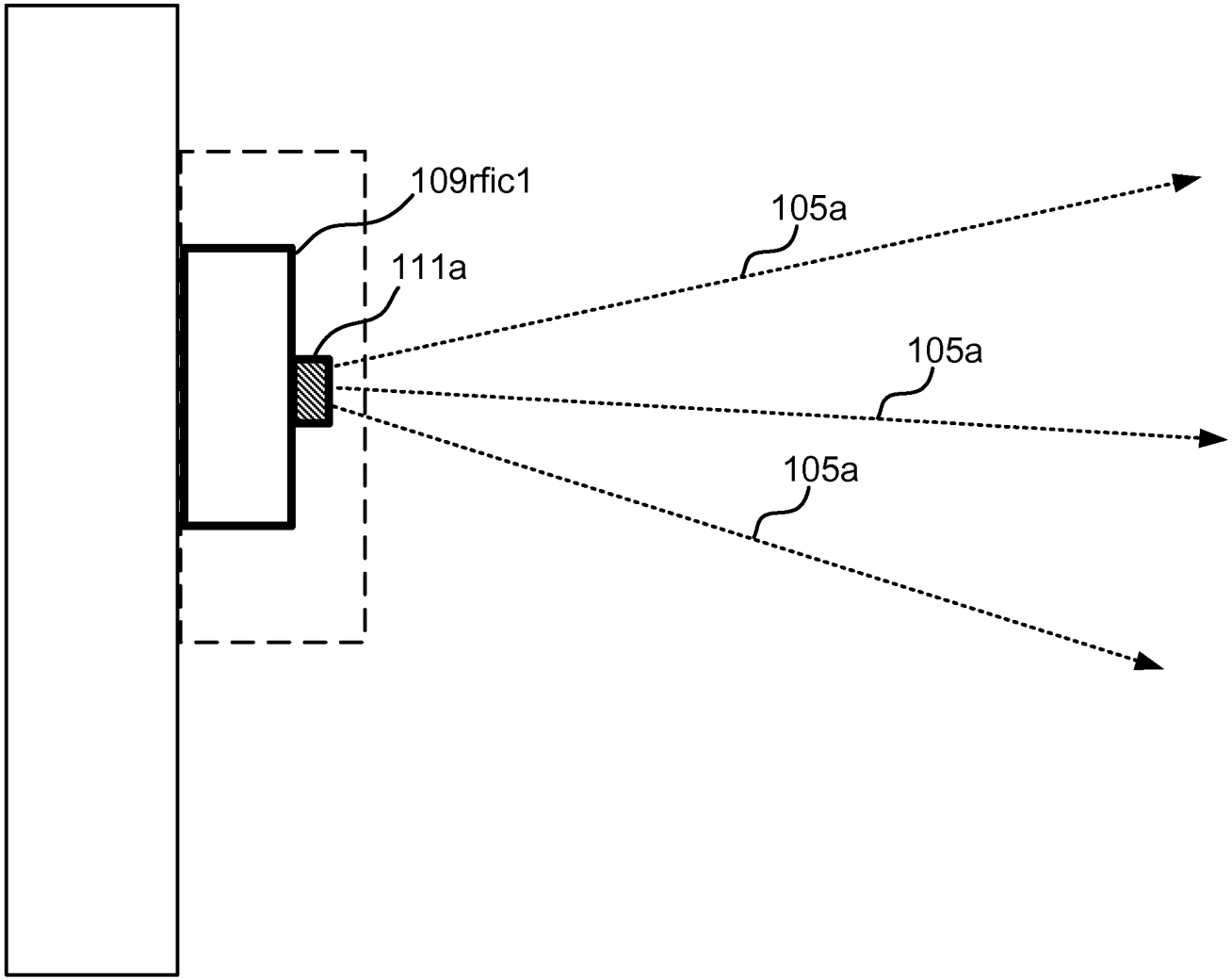
FIG. 1D illustrates one embodiment of a radiating source in a millimeter-wave communication system.
Figure 1E:
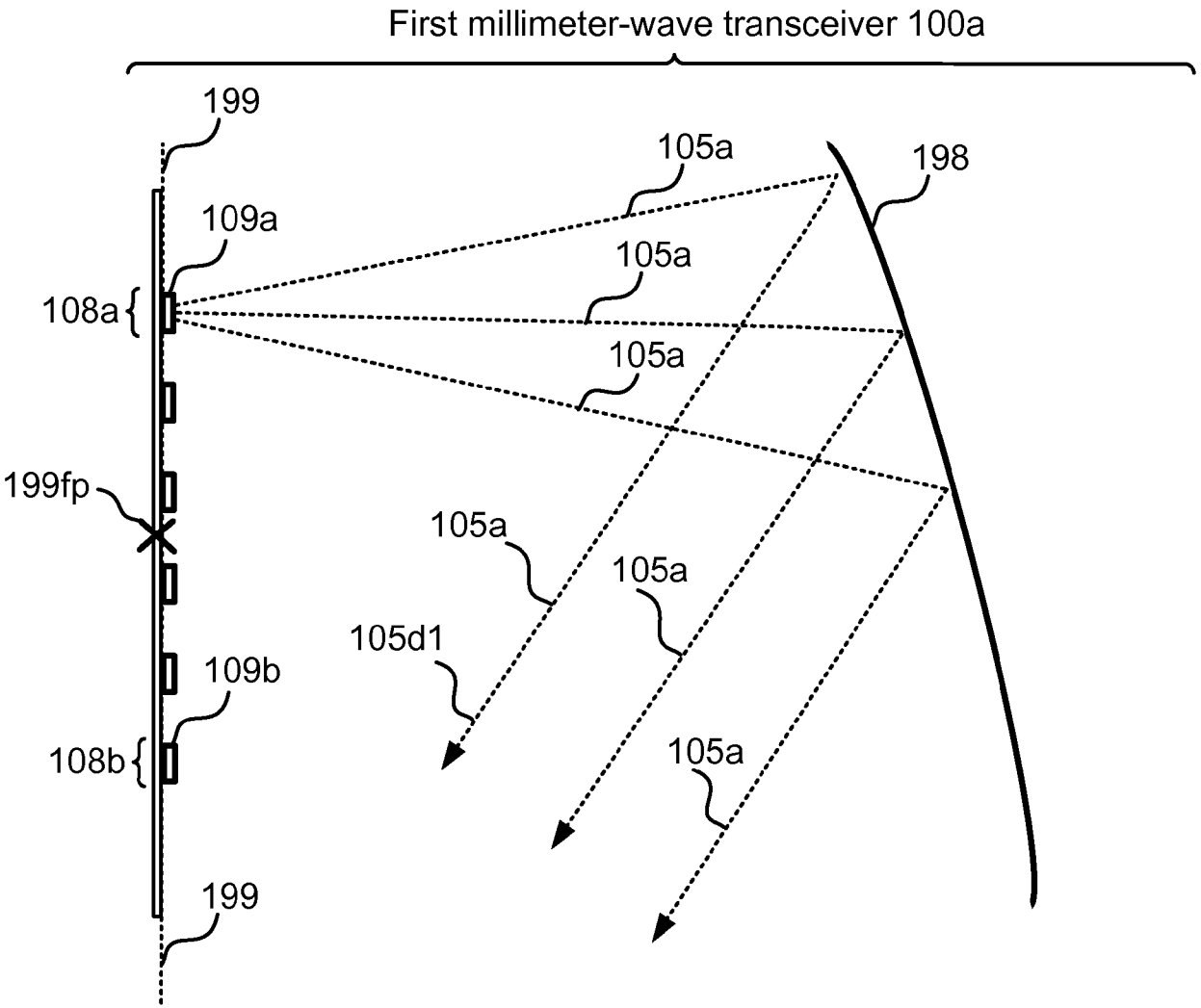
FIG. 1E illustrates one embodiment of radiating sources, placed as part of a first millimeter-wave transceiver with a millimeter-wave focusing element.

FIG. 1D illustrates an alternative embodiment of a radiating source in a millimeter-wave communication system. Here there is neither a transmission line 112*a* nor a wire bonding connection 115*a*. Rather, the antenna 111*a* is glued, soldered, or otherwise connected directly, to the RFIC 109*rfic*1.

Figure 2A:
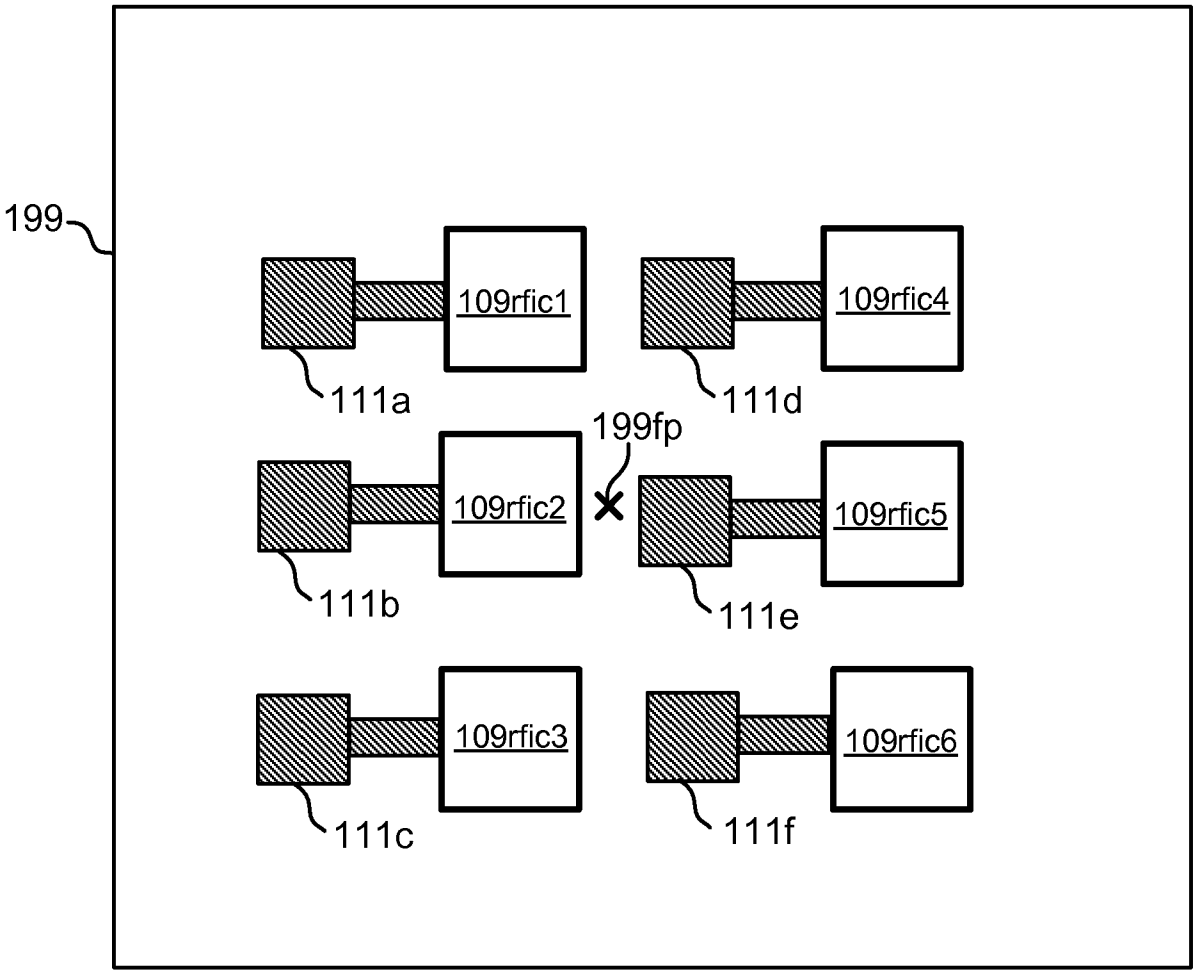
FIG. 2A illustrates one embodiment of a set of antennas on a focal surface of a millimeter-wave focusing element in proximity to various RFICs.
Figure 2B:
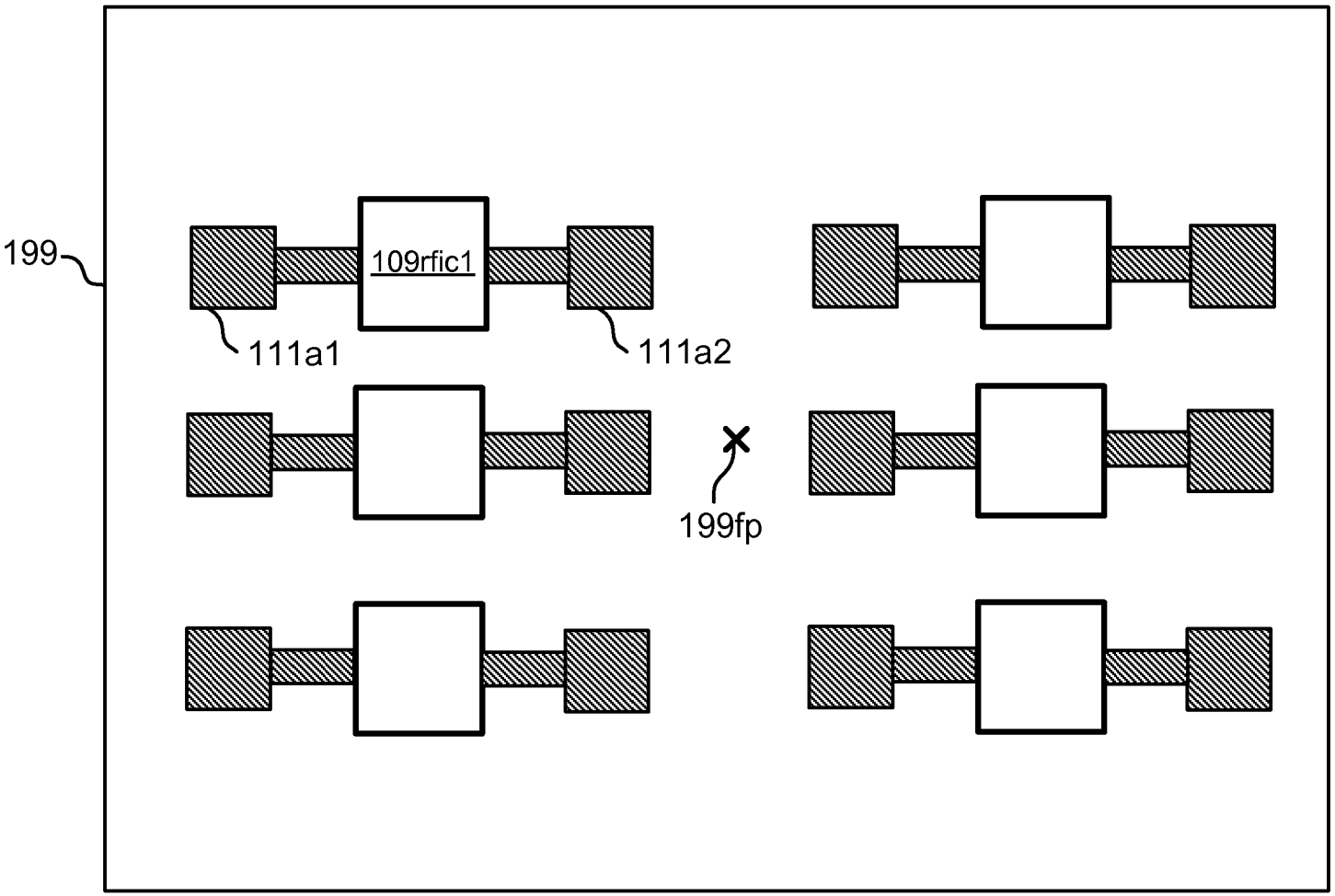
FIG. 2B illustrates one embodiment of a set of antennas on a focal surface of a millimeter-wave focusing element in proximity to various RFICs.
Figure 2C:
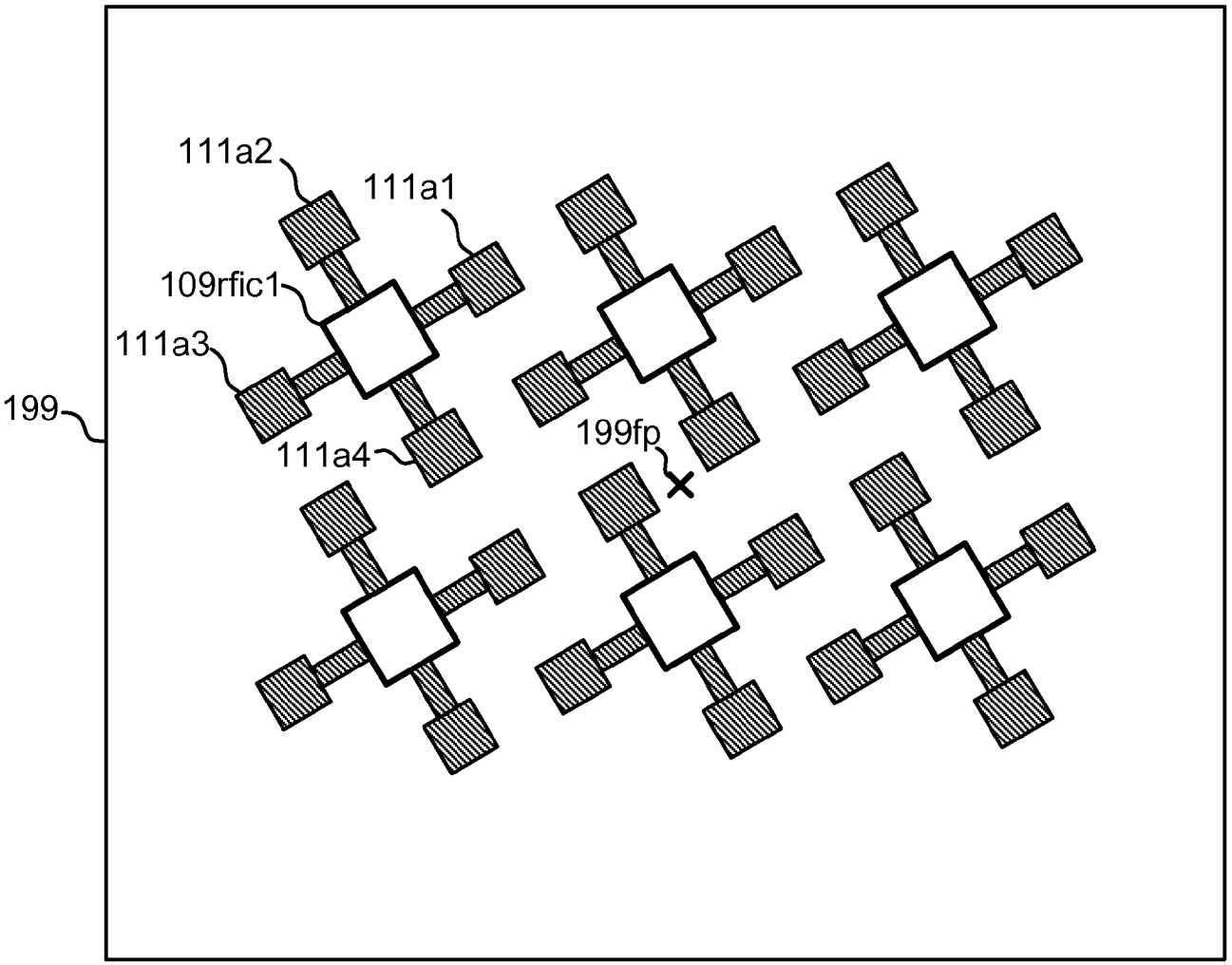
FIG. 2C illustrates one embodiment of a set of antennas on a focal surface of a millimeter-wave focusing element in proximity to various RFICs.

FIGS. 2A, 2B, 2C, and 2A, 2B, 3A, and 3B, inclusive, illustrate various embodiments of antenna and RFIC configurations. There is no limit to the number of possible antenna to RFIC configurations, provided, however, that the system includes at least two RFICs, and that there is at least one antenna located in close proximity to each RFIC. In this sense, "close proximity" means that the RFIC and antenna are located a short distance apart, and that they are connected in some way such as by a transmission line in FIG. 1B, or wire bonding in FIG. 1C, or direct placement in FIG. 1D, or by some other way of allowing the RFIC to convey a signal to the antenna. The alternative embodiments illustrated in FIGS. 2A, 2B, and 2C, are just three of many possible alternative embodiments with the RFICs and the antennas.

FIG. 2A illustrates one embodiment of a set of antennas on a focal surface of a millimeter-wave focusing element in proximity to various RFICs. Six RFICs are shown, and each RFIC is in close proximity to one antenna. These include the pairs RFIC 109*rfic*1 and antenna 111*a*, RFIC 109*rfic*2 and antenna 111*b*, RFIC 109*rifc*3 and antenna 111*c*, RFIC 109*rfic*4 and antenna 111*d*, RFIC 109*rfic*5 and antenna 1113, and RFIC 109*rifc*6 and antenna 111*f*. Each antenna is located on the focal surface 199, and the system operates to select one or more antennas that direct millimeter-wave signals toward the millimeter-wave focusing element 198.

FIG. 2B illustrates one embodiment of a set of antennas on a focal surface of a millimeter-wave focusing element in proximity to various RFICs. Six RFICs are illustrated, all of which are located on the focal surface 199. Here, however, each RFIC is connected in close proximity to two antennas, not one. An example is shown in the upper left of FIG. 2B, in which the first RFIC, 109*rfic*1, is connected in close proximity to both antenna 111*a*1 and antenna 111*a*2. Each antenna, here 111*a*1 and 111*a*2, will direct as millimeter-wave signal toward millimeter-wave focusing element 198. In one embodiment, the system will measure the signals received, determine which of the two signals is better directed to a remote target, and tell the RFIC 109*rfic*1 to transmit radiation energy only to the antenna that generates a signal better directed to said target. The description here for the triplet of elements 109*rfic*1, 111*a*1, and 111*a*2, will apply also to each of the five other triplets of an RFIC and two antennas, illustrated in FIG. 2B.

FIG. 2C illustrates one embodiment of a set of antennas on a focal surface of a millimeter-wave focusing element in proximity to various RFICs. Six RFICs are illustrated, all of which are located on the focal surface 199. Here, however, each RFIC is connected in close proximity to four antennas. An example is shown in the upper left of FIG. 2C, in which the first RFIC, 109*rfic*1, is connected in close proximity to antennas 111*a*1, 111*a*2, 111*a*3, and 111*a*4. Each antenna, here 111*a*1, 111*a*2, 111*a*3, and 111*a*4, may direct a millimeter-wave signal toward the millimeter-wave focusing element 198. In one embodiment, the system will measure the signals received from a remote target, determine which of the four signals is better directed to said remote target, and tell the RFIC 109*rfic*1 to transmit radiation energy only to the antenna that generates a signal best directed to said remote target. The description here for the quintuple of elements 109*rfic*1, 111*a*1, 111*a*2, 111*a*3, and 111*a*4, will apply also to each of the five other quintuples of an RFIC and four antennas, illustrated in FIG. 2C.

FIGS. 3A, 3B, and 3C, inclusive, illustrate various embodiments of a point-to-point communication system 100. Each of these three figures includes a first millimeter-wave transceiver 100*a* that transmits signals, a receiving transceiver 100*b* that receives the signals, and a dish, antenna, or other reception device 201 that is the actual receive of the radiated signal energy. The combination of these three figures illustrates one embodiment by which the system may operate. In FIG. 3A, a particular radiating source has been selected by the system that sends signals through the millimeter-wave focusing element, and then in the correct direction toward the receiver 100*b*. In FIG. 3B, this communication has been disrupted, because of some change. In FIG. 3B, the change illustrated is a change in the orientation of transceiver 100*a*, such that the signal radiated from the same RFIC, and transmitted from the same antenna, as in FIG. 3A, now does not travel in the correct direction toward receiver 100*b*. It is possible that some of the signal energy transmitted by first millimeter-wave transceiver 100*a* is received by receiver 100*b*, but the misdirection of the transmission means that much of the signal energy from transceiver 100*a* is not received by transceiver

100*b*. Although FIG. 3B shows communication disruption to a repositioning of transceiver 100*a*, it will be understand that the problem could have been caused by a repositioning of transceiver 100*b*, or by a repositioning of both transceivers 100*a* and 100*b*, or by some other blockage which may be either a physical blockage or RF interference such that the direction of the signal transmitted in FIG. 3A is now no longer the correct direction, as shown in FIG. 3B. In FIG. 3C, the system has corrected the problem by permitting transmission of radiation energy from a different RFIC to an antenna located in close proximity, and then having that antenna, different from the antenna in FIGS. 3A and 3B, transmit the signal. The same signal may be transmitted, but the key is that the direction has been changed by selection of a different RFIC and one or more different antennas.

In one embodiment, there is a millimeter-wave communication system 100*a* operative to direct millimeter-wave beams 105*a* and 105*b*. The system 100*a* includes a millimeter-wave focusing element 198 which operates to focus millimeter-wave beams 105*a* and 105*b*. The system 100*a* also includes two or more millimeter-wave antennas 111*a*, 111*b*, which are placed at different locations 108*a* and 108*b* on a focal surface 199 of the millimeter-wave focusing element 198. The system also includes two or more radio-frequency-integrated-circuits ("RFICs") 109*rfic*1 and 109*rfic*2, which are placed in close proximity to the millimeter-wave antennas, such that (i) each of the millimeter-wave antennas has at least one RFIC in close proximity, and (ii) each of the millimeter-wave antennas is operative to receive a millimeter-wave signal from said at least one of the RFICs located in close proximity. In some embodiments, the system 100*a* is operative to (i) select which of the millimeter-wave antennas will transmit a millimeter-wave beam 105*a* or 105*b*, and then (ii) direct to the millimeter-wave antenna selected the millimeter-wave signal from one of RFICs 109*rfic*1 or 109*rfic*2 located in close proximity to the millimeter-wave antenna selected, thereby generating a millimeter-wave beam 105*a* or 105*b* at a direction 105*d*1 or 105*d*2 which is consequent upon said selection.

In one embodiment, there is a method for controlling a direction of a millimeter-wave beam 105*a* or 105*b* in a point-to-point or point-to-multipoint communication system 100. In this embodiment a first millimeter-wave radiating source 109*a* is located at a first location 108*a* on the focal surface 199 of a millimeter-wave focusing element 198. Using this source 109*a*, the system 100 (or 100*a*) transmits a millimeter-wave beam 105*a* to a millimeter-wave focusing element 198, wherein the direction 105*d*1 of the beam 105*a* is determined by the first location 108*a*. Further, the system 100 (or 100*a*) determines a direction for the millimeter-wave beam 105*a* that is expected to best improve the communication performance of the system 100. In this sense, "improve the communication performance" means to increase the signal energy received by a receiver 100*b*, without increasing the transmission power. In this embodiment, the system 100 (or 100*a*) includes multiple radiating sources 109*a*, 109*b*, and potentially other sources, each source located at a different location on the focal surface 199, and the system 100 (or 100*a*) further identifies which of such radiating sources will, when active, transmit the beam 105*b* in a second direction 105*d*2 that is closest to the direction expected to best improve the communication performance of the system 100. In this embodiment, the radiating source 109*b* so identified transmits the beam 105*b* in the second direction 105*d*2, thereby improving the performance of the system 100.

In a first alternative embodiment to the method just described for controlling the direction of a millimeter-wave beam, further each of the first 109*a* and second 109*b* millimeter-wave radiating sources comprises a radio-frequency-integrated-circuit ("RFIC") 109*rfic*1 and 109*rfic*2 respectively.

In a first possible configuration of the first alternative embodiment, each of said RFICs 109*rfic*1 and 109*rfic*2 is mounted on a printed-circuit-board ("PCB") 197, and the PCB 197 is located (i) substantially on the focal surface 199 of the millimeter-wave focusing element 198, or (ii) slightly behind the focal surface 199 of the millimeter-wave focusing element 198.

In one possible variation of the first possible configuration just described each of the millimeter-wave radiating sources 109*a* and 109*b* further comprises a millimeter-wave antenna 111*a* and 111*b*, respectively, which operates to radiate the millimeter-wave beam 105*a* and 105*b*, respectively.

In a first possible implementation of one possible variation just described, each millimeter-wave antenna 111*a* and 111*b* is printed on the PCB 197 in close proximity to the corresponding RFIC 109*rfic*1 and 109*rfic*2, respectively.

In a first possible expression of the first possible implementation just described, each RFIC 109*rfic*1 and 109*rfic*2 is mounted using flip-chip mounting technology, and each RFIC is connected directly to its corresponding millimeter-wave antenna 111*a* and 111*b*, respectively, via a transmission line 112*a* printed on the PCB 197.

In a second possible expression of the first possible implementation just described, each RFIC 109*rfic*1 and 109*rfic*2 is connected to its corresponding millimeter-wave antenna 111*a* and 111*b*, respectively, via a bonding wire 115*a*.

In a second further implementation of one possible variation just described, each RFIC 109*rfic*1 and 109*rfic*2 is operative to convert a base-band signal or an intermediate-frequency signal into a millimeter-wave signal, and this millimeter-wave signal is injected into said millimeter-wave antenna 111*a* and 111*b*, respectively, thereby generating said millimeter-wave beam 105*a* and 105*b*, respectively.

In a third further implementation of one possible variation just described, each of the millimeter-wave antennas 111*a* and 111*b*, is located on top of its corresponding RFIC 109*rfic*1 and 109*rfic*2, respectively, or on top of an enclosure of said RFIC, and each of the millimeter-wave antennas 111*a* and 111*b* faces the millimeter-wave focusing element 198.

In one possible expression of the third further implementation just described, each of the millimeter-wave antennas 111*a* and 111*b* is printed on its corresponding RFIC 109*rfic*1 and 109*rfic*2, respectively.

In a second possible configuration of the first alternative embodiments, the RFICs 109*rfic*1 and 109*rfic*2 are operative to convert a base-band signal or an intermediate-frequency signal into a millimeter-wave signal operative to generate the millimeter-wave beam 105*a* or 105*b*.

In a first possible variation of the second possible configuration just described, the base-band signal or intermediate-frequency signal is delivered to the RFICs 109*rfic*1 and 109*rfic*2, and selection of said first 105*d*1 or second 105*d*2 directions is done by commanding the first 109*rfic*1 or second 109*rfic*2 RFICs, respectively, to start generating the millimeter-wave beams 105*a* and 105*b*, respectively.

In a first further implementation of the first possible variation just described, the base-band signal or intermediate-frequency signal is an analog signal.

In a second further implementation of the first possible variation just described, the base-band signal is a digital signal.

In a second possible variation of the second possible configuration just described, the base-band signal or intermediate-frequency signal is delivered to the first RFIC 109*rfic*1, thereby facilitating selection of the first direction 105*d*1.

In a third possible variation of the second possible configuration just described, the base-band signal or intermediate-frequency signal is delivered to the second RFIC 109*rfic*2, thereby facilitating selection of the second direction 105*d*2.

In a second alternative embodiment to the method described for controlling the direction of a millimeter-wave beam, further each of said first 109*a* and second 109*b* millimeter-wave radiating sources includes an antenna, 111*a* and 111*b*, respectively, printed on a PCB 197, and the PCB 197 is located substantially on the focal surface 109 of the millimeter-wave focusing element 198.

In a third alternative embodiment to the method described for controlling the direction of a millimeter-wave beam, further (i) the millimeter-wave focusing element 198 belongs to a first millimeter-wave transceiver 100*a* of said system 100, and (ii) the millimeter-wave beam 105*a* is used by the first millimeter-wave transceiver 100*a* to communicate with a second millimeter-wave transceiver 100*b* that is part of the system.

In a first possible configuration of the third alternative embodiment, improving performance of the system 100 becomes required or preferred due do undesired movement of the millimeter-wave focusing element 198 relative to the second millimeter-wave transceiver 100*b*, or undesired movement of the second millimeter-wave transceiver 100*b* relative to the millimeter-wave focusing element 198, or undesired movement of both the millimeter-wave focusing element 198 and the second millimeter-wave transceiver 100*b* relative to one another, other physical movement or blockage, or other RF interference.

In one possible variation of first possible configuration just described, the undesired movement is caused by wind.

In a second possible configuration to the third alternative embodiment, improving performance is required or preferred in order to direct the beam 105*a* toward the second millimeter-wave transceiver 100*b* when the first millimeter-wave transceiver 100*a* is initially installed.

In one embodiment, there is a method for directing millimeter-wave beams 105*a* and 105*b*. In this embodiment, a point-to-point or point-to-multipoint communication system 100 determines a direction 105*d*1 to which a millimeter-wave beam 105*a* is to be transmitted. There are multiple millimeter-wave antennas 111*a* to 111*f*, inclusive in system 100*a*, each such antenna placed at a different location on the focal surface 199 of a millimeter-wave focusing element 198. In this embodiment, the system 100 (or 100*a*) identifies of such antennas 111*a*-111*f*, which is best placed relative to a focal point 199*fp* of the millimeter-wave focusing element 198 to facilitate transmission of the beam 105*a* in this direction 105*d*1. There are multiple RFICs in the system, such that every antenna 111*a*-111*f* is located in close proximity to an RFIC. In this embodiment, an RFIC located in close proximity to the identified antenna generates a millimeter-wave signal 105*a* which is sent from the RFIC to the identified antenna, and the identified antenna then transmits the signal toward the identified direction 105*d*1.

In a first alternative embodiment to the method just described for directing millimeter-wave beams, further the first RFIC 109*rfic*1 is uniquely associated with said first millimeter-wave antenna 111*a*, as shown in FIG. 2A. In this sense, "uniquely associated with" means that RFIC 109*rfic*1 is the only RFIC that is connected to antenna 111*a*.

In one possible configuration of the first alternative embodiment just described, each of the millimeter-wave antennas 111*a* to 111*f*, inclusive, is uniquely associated with an RFIC, 109*rfic*1 to 109*rfic*6, respectively, as shown in FIG. 2*a*.

In a second alternative embodiment to the method described for directing millimeter-wave beams, the first RFIC 109*rfic*1 is associated with a first millimeter-wave antenna 111*a*1 and with a second millimeter-wave antenna 111*a*2, where each such antenna is located in close proximity to the first RFIC 109*rfic*1, as shown in FIG. 2A.

In one possible configuration of the second alternative embodiment just described, the method further includes (i) the system 100 (or 100*a*) determines a second direction 105*d*2 via which a millimeter-wave beam 105*a* is to be transmitted, (ii) the system 100 (or 100*a*) identifies which of the millimeter-wave antennas placed at different locations on a focal surface 199*fp* of a millimeter-wave focusing element 198, is best placed relative to a focal point 199*fp* of said millimeter-wave focusing element 198 to facilitate transmission of the millimeter-wave beam 105*a* in the second direction 105*d*2, and (iii) the first RFIC 109*rfic*1 generates a millimeter-wave signal which is delivered to the second millimeter-wave antenna 111*a*2, which then transmits the millimeter-wave beam 105*b* toward the second direction 105*d*2.

In a third alternative embodiment to the method described for directing millimeter-wave beams, further (i) the system 100 (or 100*a*) determines a second direction 105*d*2 via which a millimeter-wave beam 105*a* is to be transmitted, (ii) the system 100 (or 100*a*) identifies a second millimeter-wave antenna 111*b* placed at different location on a focal surface 199*fp* of a millimeter-wave focusing element 198, which is best placed relative to a focal point 199*fp* of said millimeter-wave focusing element 198 to facilitate transmission of the millimeter-wave beam 105*a* in the second direction 105*d*2, and (iii) the system 100 (or 100*a*) includes a second RFIC 109*rfic*2 located in close proximity to a second millimeter-wave antenna 111*b*, and the second RFIC 109*rfic*2 generates a millimeter-wave signal which is delivered to the second millimeter-wave antenna 111*b*, which then transmits a millimeter-wave beam 105*b* toward the second direction 105*d*2.

Figure 4:
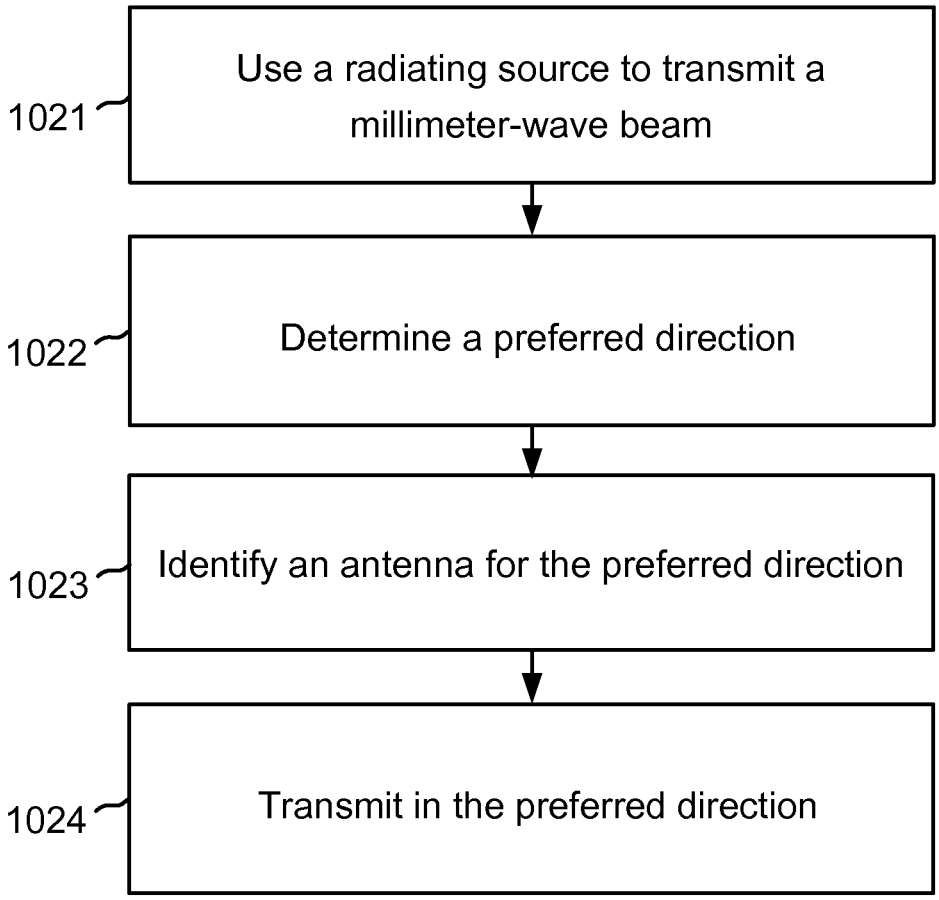
FIG. 4 illustrates a flow diagram describing one method for controlling a direction of a millimeter-wave beam in a point-to-point millimeter-wave communication system.

FIG. 4 illustrates one embodiment of a method for controlling a direction of a millimeter-wave beam 105*a* or 105*b* in a point-to-point or point-to-multipoint communication system 100. In step 1021, using a first millimeter-wave radiating source 109*a* located at a first location 108*a* on a focal surface 199 of a millimeter-wave focusing element 198, to transmit a millimeter-wave beam 105*a* via said millimeter-wave focusing element, wherein said millimeter-wave beam having a first direction 105*d*1 consequent upon the first location. In step 1022, determining a desired direction for the millimeter-wave beam, wherein said desired direction is expected to improve performance of a point-to-point millimeter-wave communication system employing the millimeter-wave beam. In step 1023, identifying, out of a plurality of millimeter-wave radiating sources, a second millimeter-wave radiating source 109*b* located at a second location 108*b* on the focal surface of the millimeter-wave focusing element, which when in use will result in a second direction 105*d*2 for the millimeter-wave beam 105*b* that is closest to the desired direction for the millimeter-wave beam. In step 1024, using the second millimeter-wave radiating source to transmit the millimeter-wave beam 105*b* having the second direction consequent upon the second location, thereby improving performance of the point-to-point millimeter-wave communication system.

Figure 5:
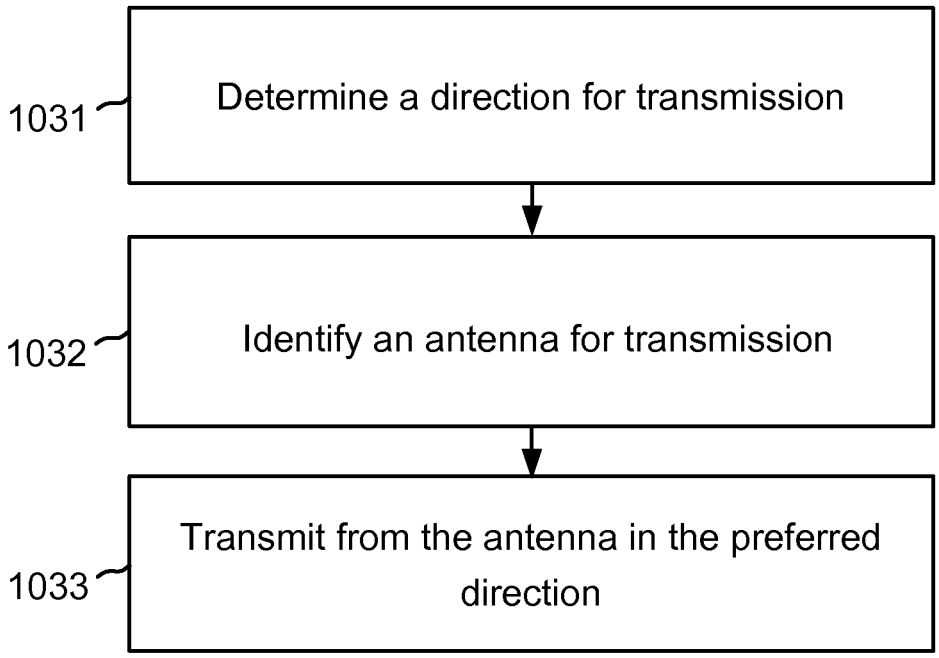
FIG. 5 illustrates a flow diagram describing one method for directing millimeter-wave beams in a point-to-point millimeter-wave communication system.

FIG. 5 illustrates one embodiment of a method for directing millimeter-wave beams 105*a* and 105*b*. In step 1031, determining a direction via which a millimeter-wave beam is to be transmitted. In step 1032, identifying, out of a plurality of millimeter-wave antennas 111*a* to 111*f* placed at different locations on a focal surface 199 of a millimeter-wave focusing element, a first millimeter-wave antenna, 111*a* as an example, which is: best placed, relative to a focal point 199*fp* of said millimeter-wave focusing element, to best facilitate transmission of said millimeter-wave beam via said direction. In step 1033, generating, by a first radio-frequency-integrated-circuit 109*rfic*1 located in close proximity to said first millimeter-wave antenna, a millimeter-wave signal which is delivered to said first millimeter-wave antenna, thereby transmitting said millimeter-wave beam toward said direction.

Figure 6A:
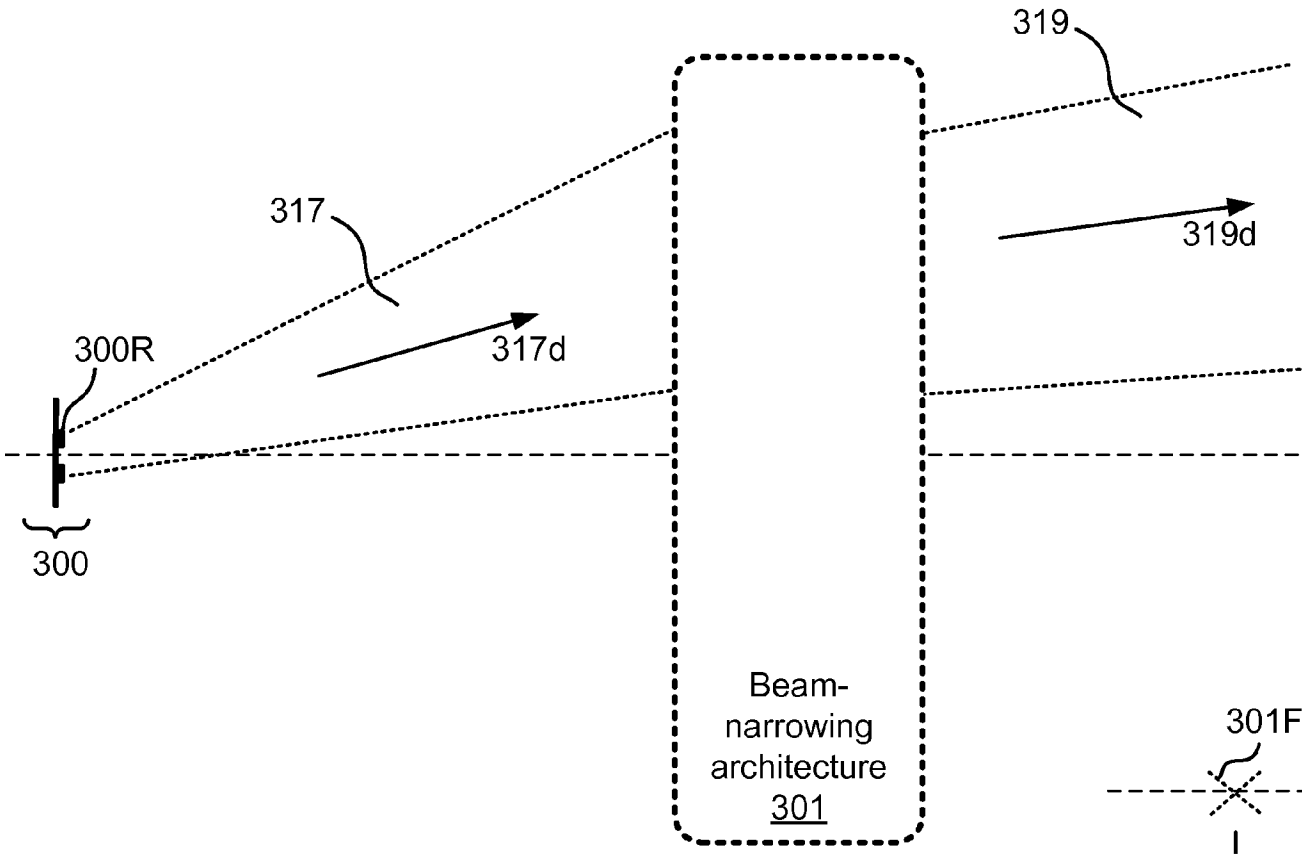
FIG. 6A illustrates one embodiment of a communication system, in which the width of a transmission beam is narrowed by a beam-narrowing architecture.

FIG. 6A illustrates one embodiment of a communication system, in which the width of a transmission beam is narrowed by a beam-narrowing architecture. An array 300 of electromagnetic radiators 300R generates a signal in the form of a first electromagnetic beam 317, which is traveling in a configurable direction 317*d*, and with an original beam-width 317W in FIG. 6C. The beam 317 enters a structure termed here a beam-narrowing architecture 301, which narrows the beam 317 and thereby converts it into a second beam 319 which has a direction 319*d* and a beam-width 319W in FIG. 6D. The beam-width 319W of the beam 319 is narrower than the beam-width 317W of the original beam 317.

Figure 6B:
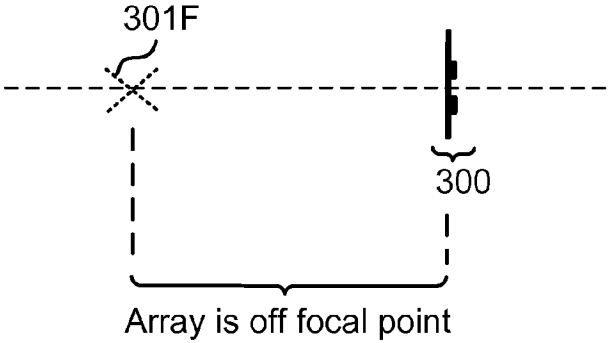
FIG. 6B illustrates one embodiment of a communication system, in which the beam-narrowing architecture has an effective focal point, and electromagnetic radiators in the system are located off the effective focal point in such a manner as to narrow the width of the final beam.

FIG. 6B illustrates one embodiment of a communication system, in which the beam-narrowing architecture has an effective focal point, and electromagnetic radiators in the system are located off the effective focal point in such a manner as to narrow the beam-width of the final beam. The beam-narrowing architecture 301 has an effective focal-point 301F, but the array 300 of electromagnetic radiators 300R is physically located at a point other than the effective focal-point 301F. There are at least two consequences of this placement of the array 300 of electromagnetic radiators 300R. First, the final beam 319 has a beam-width 319W that is narrower than the beam-width 317W of the original beam. Second, the direction 319*d* of the final beam 319 may be different than the direction 317*d* of the original beam 317.

Figure 6C:
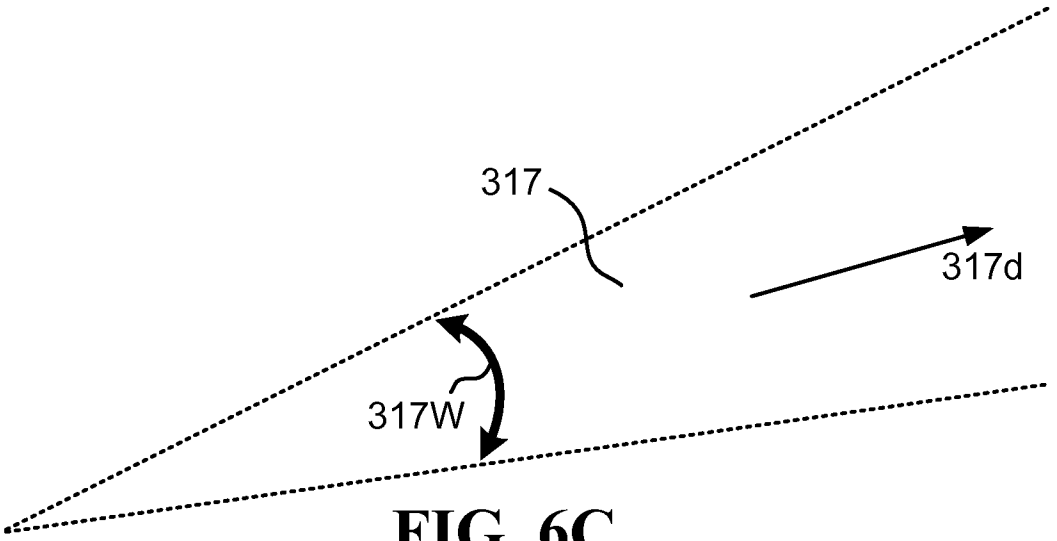
FIG. 6C illustrates one embodiment of a communication system, in which the beam-width of a transmission is relatively large, resulting in greater signal dispersion and lower associated antenna gain.

FIG. 6C illustrates one embodiment of a communication system, in which the beam-width of a transmission is relatively large, resulting in greater signal dispersion and lower associated antenna gain. The original electromagnetic beam 317 travels in a particular direction 317*d*, and has a certain beam-width 317W.

Figure 6D:
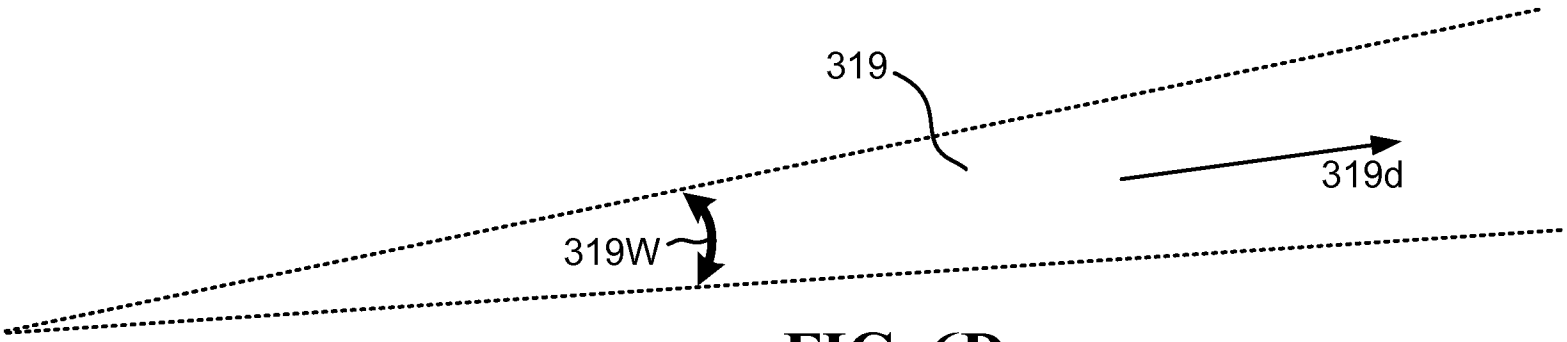
FIG. 6D illustrates one embodiment of a communication system, in which the width of a transmission is relatively small, resulting in less signal dispersion and higher associated antenna gain.

FIG. 6D illustrates one embodiment of a communication system, in which the beam-width of a transmission is relatively small, resulting in less signal dispersion and higher communication gain. The consequent electromagnetic beam 319 has passed through the beam-narrowing architecture 301, and now has a particular direction 319*d* and a certain beam-width 319W which is narrower than the beam-width 317W of the original beam 317.

Figure 7A:
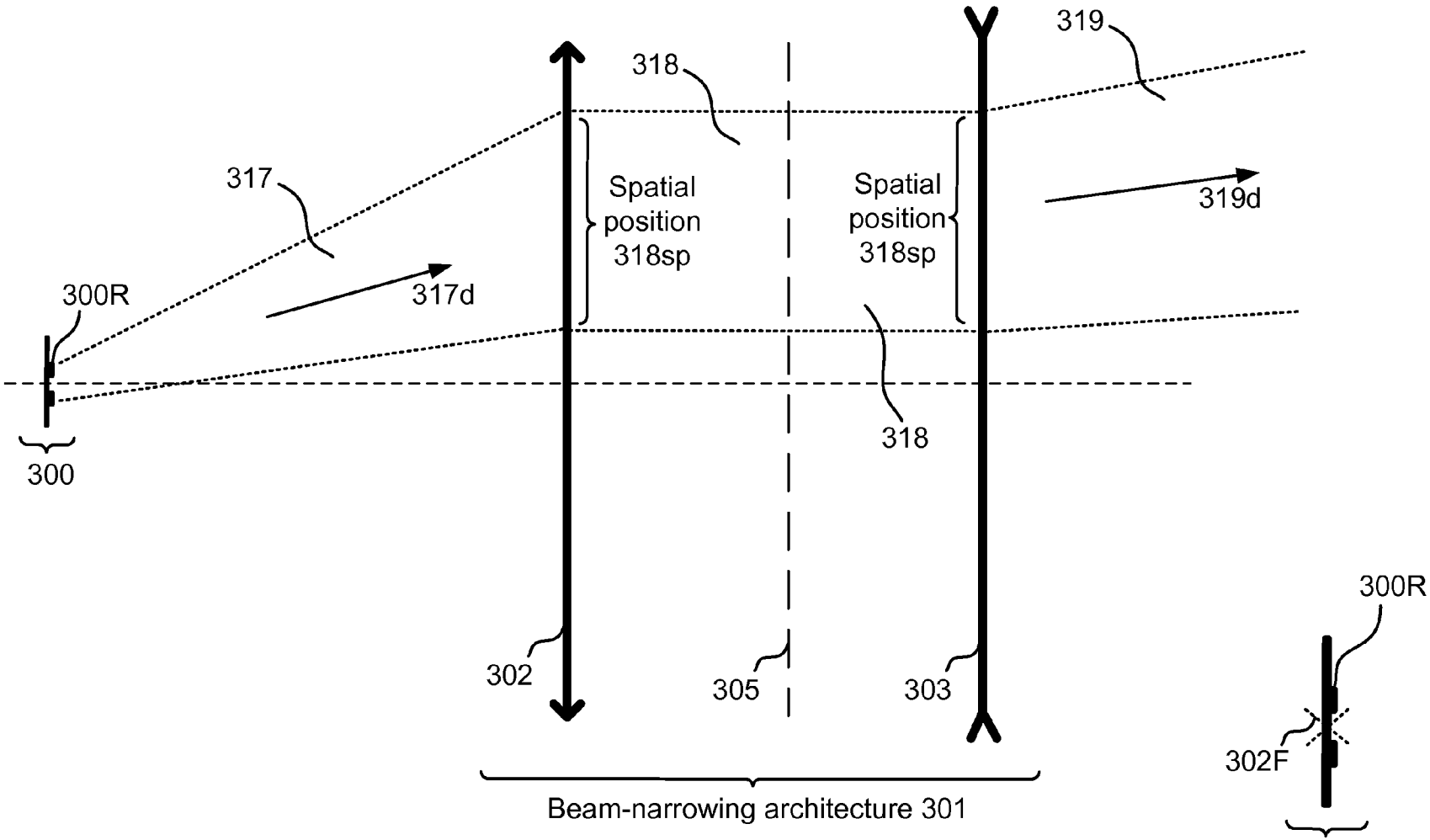
FIG. 7A illustrates one embodiment of a communication system, with a beam-focusing element and a beam-dispersing element, such that the system converts a first beam with a given beam-width into a final beam with a narrower beam-width.

FIG. 7A illustrates one embodiment of a communication system, with a beam-focusing element and a beam-dispersing element, such that the system changes a first beam with a given beam-width into a final beam with a narrower beam-width. FIG. 7A illustrates also one possible embodiment of a beam-narrowing architecture 301. In FIG. 7A, the original beam 317 enters the beam-narrowing architecture 301 and passes through a beam-focusing element 302, which translates the original beam 317 into an intermediate beam 318 which has a spatial position at 318*sp* derived from the configurable direction 317*d* of the original beam 317. One example of a beam-focusing element 302 is a focusing lens. FIG. 7A shows the operation of the beam-focusing element 302 such that the original beam 317 appears as dispersing beam and the intermediate beam 318 appears as a parallel beam.

In FIG. 7A, the intermediate beam 318 may pass through a transparent sheet of material 305, which is located between the beam-focusing element 302 and the beam-dispersing element 303, and wherein the transparent sheet 305 is operative to affect at least one electromagnetic property of the intermediate beam 318 before the intermediate beam 318 is modified into the final electromagnetic beam 319. Transparent sheet of material 305 is optional, and may not appear in some embodiments. Further, the intermediate beam 318 passes through the beam-dispersing element 303, such that the intermediate beam 318 is modified into the final beam 319 that has a direction 319*d* and a beam-width 319W that is narrower than the beam-width 317W of the original beam 317. One example of a beam-dispersing element 303 is a dispersing lens.

Figure 7B:
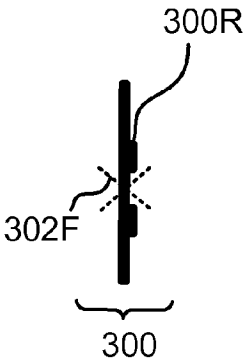
FIG. 7B illustrates one embodiment of a communication system, in which a beam focusing element has a first focal point, and an array of electromagnetic radiators is located substantially at this focal point.

FIG. 7B illustrates one embodiment of a communication system, in which a beam focusing element has a first focal point, and an array of electromagnetic radiators is located substantially at this focal point. In FIG. 7B, the beam-focusing element 302 has a first focal point 302F, the position of which is marked by an X in FIG. 7B. The array 300 of electromagnetic radiators 300R is located substantially at this focal point 302F. The consequence is that the intermediate beam 318 shown is FIG. 7B is substantially a parallel beam, which facilitates the translation of the original beam 317 into the intermediate beam 318 having a spatial position 318*sp* consequent on the configurable direction 317*d* of the original beam 317.

Figure 8:
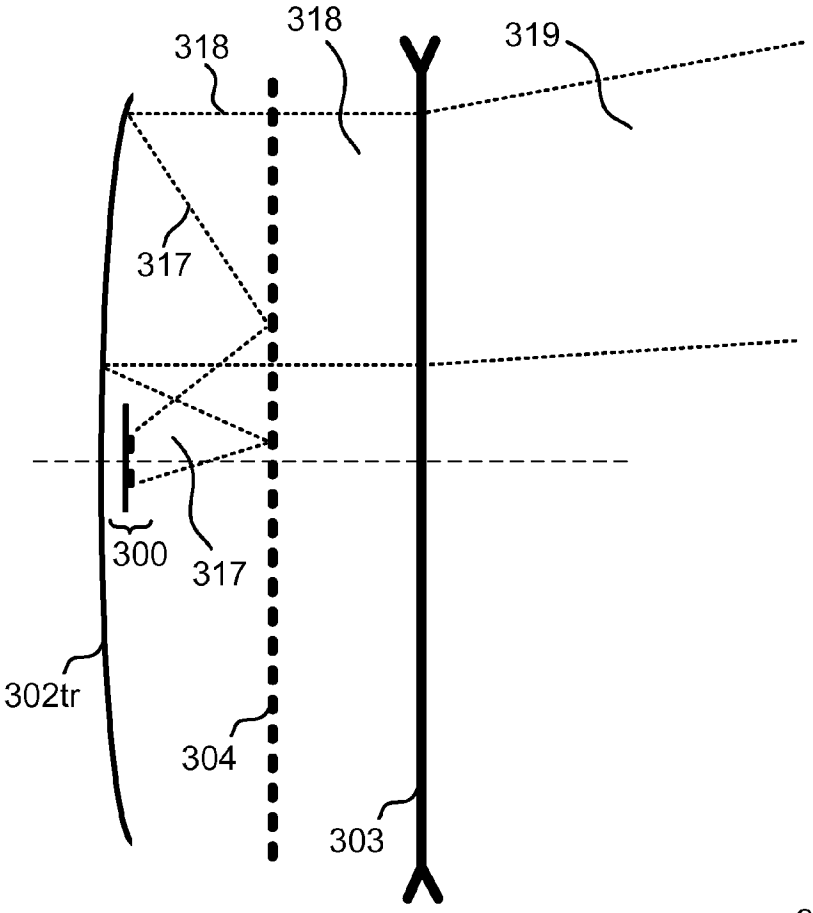
FIG. 8 illustrates one embodiment of a communication system, including a twist reflector such that beam-width of an original beam is reduced in a resulting beam, and the process of reduction occurs substantially within a beam-narrowing architecture.

FIG. 8 illustrates one embodiment of a communication system, including a twist reflector such that the beam-width of an original beam is reduced in a resulting beam, and the process of reduction occurs substantially within a beam-narrowing architecture. FIG. 8 achieves essentially the same results as achieved in FIG. 6A, except in FIG. 8, unlike FIG. 6A, the array 300 of electromagnetic radiators 300R is located substantially within the beam-narrowing architecture 302, such that the overall size of the system illustrated in FIG. 8 may be less than the overall size of the system illustrated in FIG. 6A. In FIG. 8, the first electromagnetic beam 317 has a first electromagnetic polarity, and the beam-focusing element 302 is a twist-reflector 302*tr* rather than the focusing lens shown in FIG. 6A. In addition, there is a polarizing surface 304, which reflects the first beam 317 as a result of the polarity of the first beam 317, such that the first beam 317 is reflected from the polarizing surface 304 to a twist reflector 302*tr*. The twist reflector 302*tr* translates the first beam 317 into an intermediate beam 318, where the intermediate beam 318 has a polarity that is orthogonal to the polarity of the original beam 317. As a result of the orthogonal polarity of the intermediate beam 318, this intermediate beam 318 passes through the polarizing surface 304, arrives at a beam-dispersing element 303, and is then modified by the beam-dispersing element 303 to become the final beam 319.

Figure 9:
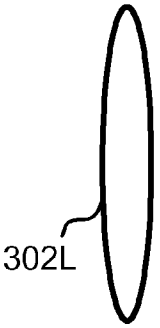
FIG. 9 illustrates one embodiment of a communication system, in which a beam-focusing element is a beam-focusing lens.

FIG. 9 illustrates one embodiment of a communication system, in which a beam-focusing element is a beam-focusing lens. FIG. 9 shows one embodiment of a beam-focusing element 302. The embodiment is a beam-focusing lens 302L. It will be understood that this is only one example of the shape such a beam-focusing lens 302L may take. It will be understood that the beam-focusing element 302 may be any other type of structure that concentrates the energy of an electromagnetic beam, such as, for example, a Fresnel lens.

Figure 10:
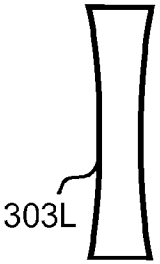
FIG. 10 illustrates one embodiment of a communication system, in which a beam-dispersing element is a beam-dispersing lens.

FIG. 10 illustrates one embodiment of a communication system, in which a beam-dispersing element is a beam-dispersing lens. FIG. 10 shows one embodiment of a beam-dispersing element 303. The embodiment is a beam-dispersing lens 303L. It will be understood that this is only one example of the shape such a beam-dispersing lens 303L may take. It will be understood that the beam-dispersing element 303 may be any other type of structure that disperses the energy of an electromagnetic beam, such as, for example, an electromagnetic scattering element, or various combinations of reflecting surfaces that adjust the direction of an electromagnetic beam.

Figure 11:
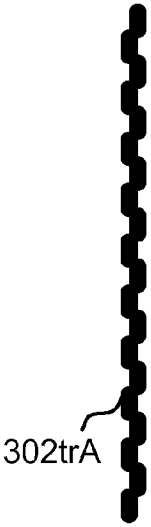
FIG. 11 illustrates one embodiment of a communication system, in which a twist reflect array is operative to emulate the curvature of a twist reflector.

FIG. 11 illustrates one embodiment of a communication system, in which a twist reflect array is operative to emulate the curvature of a twist reflector. FIG. 11 shows one embodiment of a twist reflect array 302*tr*A. The structure shown 302*tr*A emulates the curvature of a twist reflector 302*tr*, such that the twist reflect array 302*tr*A may be used as an embodiment alternative to the use of the twist reflector 302*tr*. As with the twist reflector 302*tr*, the twist reflect array 302*tr*A concentrates electromagnetic energy, thereby decreasing the dispersion of an original beam 317, and converting the original beam 317 to a final beam 319 of narrower beam-width. It will be understood that the specific structure shown in 302*tr*A is only one form of a twist reflect array, and any structure may be used that emulates the curvature of a twist reflector 302*tr*.

Figure 12B:
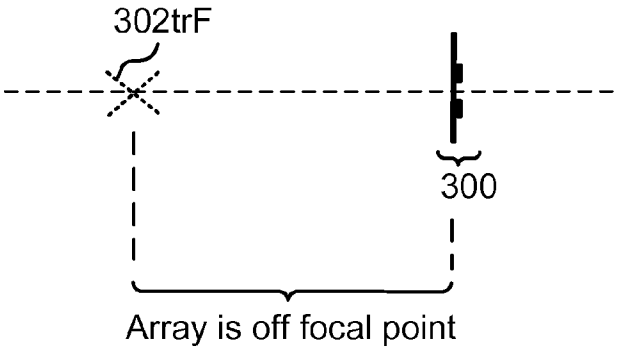
FIG. 12B illustrates one embodiment of a communication system, with a twist reflector and a polarizing surface but not a separate beam-dispersing element, in which the twist reflector has a focal point and an array of electromagnetic radiators is located off the twist reflector's focal point; the location of the array allows the system to narrow the width of the final beam.
Figure 12A:
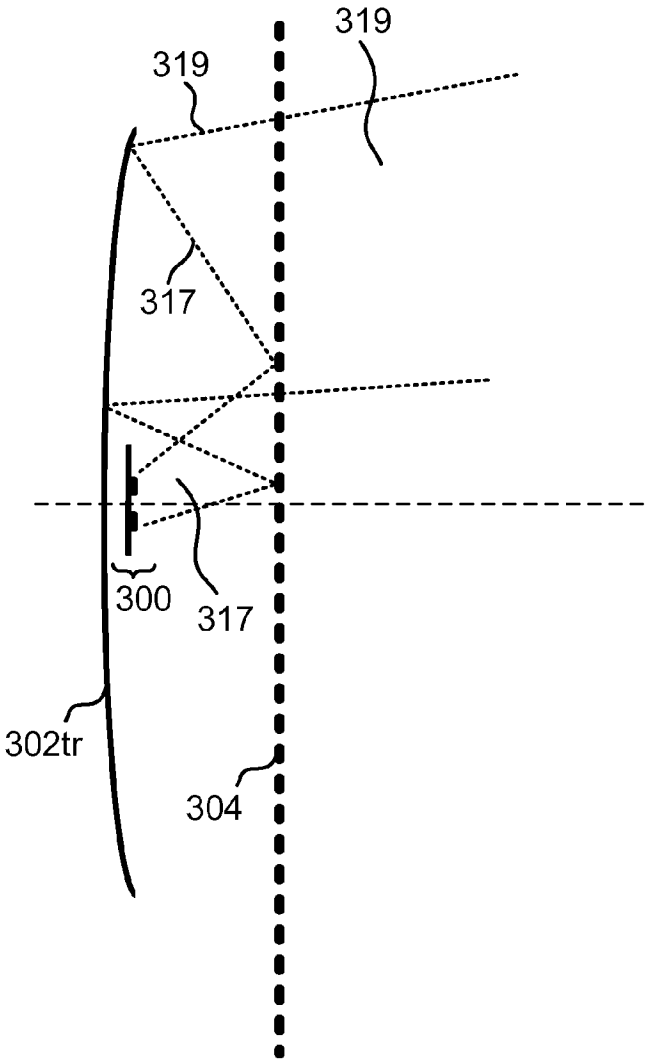
FIG. 12A illustrates one embodiment of a communication system, with a twist reflector and a polarizing surface, in which the system is operative to change a first beam with a given beam-width to a second beam of a narrower beam-width, without the use of a separate beam-dispersing element.

FIG. 12A illustrates one embodiment of a communication system, with a twist reflector and a polarizing surface, in which the system is operative to change a first beam with a given beam-width to a second beam of a narrower beam-width, without the use of a separate beam-dispersing element. The system illustrated in FIG. 12A achieves substantially the same results as the results achieved by the system illustrated in FIG. 8, except that in FIG. 12A there is no beam-dispersing element 303. In FIG. 12A, an array 300 of electromagnetic radiators 300R generates a first electromagnetic beam 317 that has a first electromagnetic polarity. The beam-narrowing architecture 301 includes a twist-reflector 302*tr* and a polarizing surface 304. The polarizing surface 304 reflects first beam 317 as a result of the first beam's 317 first electromagnetic polarity. The twist-reflector 302*tr* then converts the first beam 317 into a final electromagnetic beam 319, such that the final beam 319 has a second electromagnetic polarity that is orthogonal to the electromagnetic polarity of the first beam 317. As a result of this second polarity, the polarizing surface 304 allows the final electromagnetic beam 319 to pass-through the polarizing surface.

FIG. 12B illustrates one embodiment of a communication system, with a twist reflector and a polarizing surface but not a separate beam-dispersing element, in which the twist reflector has a focal point and an array of electromagnetic radiators is located off the twist reflector's focal point. The location of the array allows the system to narrow the beam-width of the final beam. The twist reflector 302*tr* has a focal-point 302*tr*F, but the array 300 of electromagnetic radiators 300R is physically located at a point other than the focal-point 302*tr*F. There are at least two consequences of this placement of the array 300 of electromagnetic radiators 300R. First, the final beam 319 has a beam-width 319W that is narrower than the beam-width 317W of the original beam. Second, the direction 319*d* of the final beam 319 may be different than the direction 317*d* of the original beam 317.

Figure 13B:
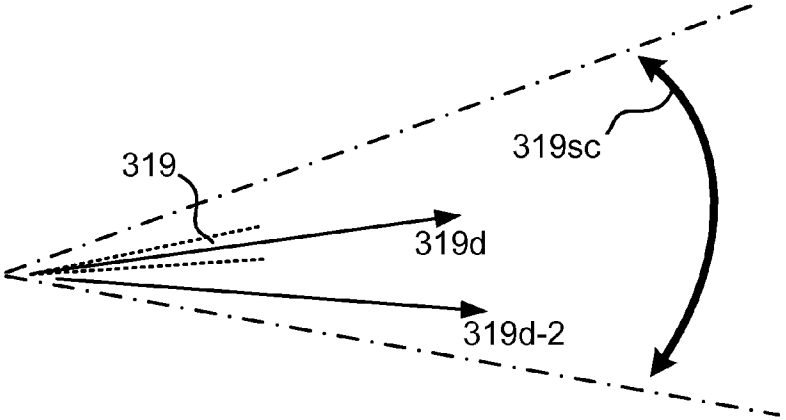
FIG. 13B illustrates one embodiment of results ensuing when the direction of a final electromagnetic beam is dependent upon the direction of a first electromagnetic beam, a communication system changes the direction of the first electromagnetic beam, and the bearing of the final beam is consequently changed.
Figure 13C:
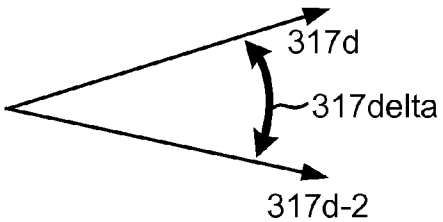
FIG. 13C illustrates one embodiment of an angular difference between a first direction and a second direction of a first electromagnetic beam.
Figure 13D:
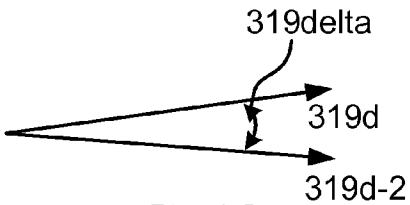
FIG. 13D illustrates one embodiment of an angular difference between a first bearing and a second bearing of a final electromagnetic beam.
Figure 13A:
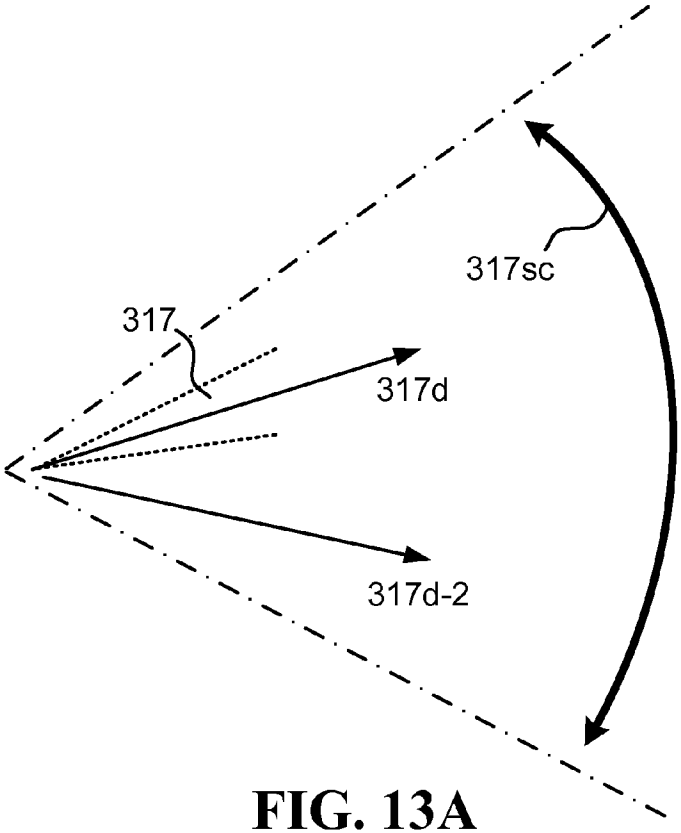
FIG. 13A illustrates one embodiment of results ensuing when a communication system changes the direction of a first electromagnetic beam.

FIG. 13A illustrates one embodiment of results ensuing when a communication system changes the direction of a first electromagnetic beam. In FIG. 13A, a first beam 317 is propagated in a first direction 317*d*. A communication system, including an array 300 of electromagnetic radiators 300R, then changes the direction of the first beam to a new direction 317*d*-2. Both the first direction 317*d* and the new direction 317*d*-2 are within a first angular scanning span 317*sc* of array 300.

FIG. 13B illustrates one embodiment of results ensuing when the bearing of a final electromagnetic beam is dependent upon the direction of a first electromagnetic beam, a communication system changes the direction of the first electromagnetic beam, and the bearing of the final beam is consequently changed. The system changes the direction of the first beam 317 from a first direction 317*d* to a new direction 317*d*-2, and the result is that the bearing of the final beam 319 changes from a first bearing 319*d* to a new bearing 319*d*-2. Both the first bearing 319*d* and the new bearing 319*d*-2 are within a second angular scanning span 319*sc* that is smaller than the first angular scanning span 317*sc* of array 300, and is related to the first angular scanning span 317*sc* via beam-narrowing architecture 301.

FIG. 13C illustrates one embodiment of an angular difference between a first direction and a second direction of a first electromagnetic beam. In FIG. 13C, 317delta is the angular difference between the first direction 317*d* and the second direction 317-2 of first electromagnetic beam 317.

FIG. 13D illustrates one embodiment of an angular difference between a first bearing and a second bearing of a final electromagnetic beam. In FIG. 13D, 319delta is the angular difference between the first bearing 319*d* and the second bearing 319-2 of final electromagnetic beam 319. In some embodiments, the difference between 317delta and 319delta in substantial, such that 317delta is substantially larger than 319delta. In this way, a relatively large change 317delta in the direction of the first beam 317 can have a smaller change 319delta in the direction of the final beam 319, such that relatively accurate control may be exercised over the bearing of the final beam 319.

Figure 14A:
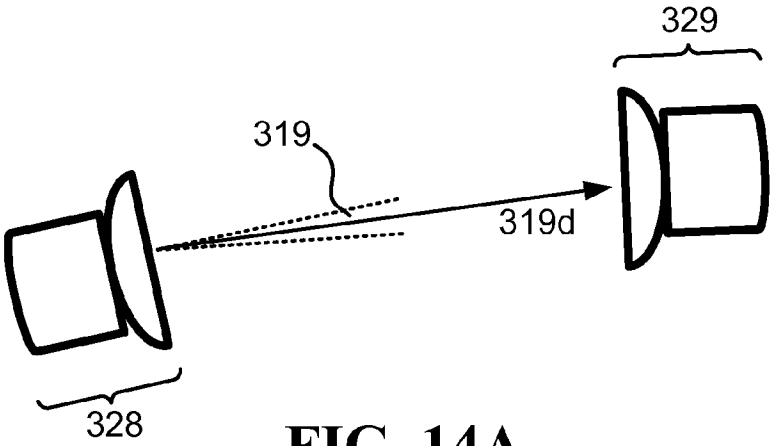
FIG. 14A illustrates one embodiment of a communication system, in which a beam-narrowing architecture belongs to a point-to-point communication system.

FIG. 14A illustrates one embodiment of a communication system, in which a beam-narrowing architecture belongs to a point-to-point communication system. In FIG. 14A, there is a point-to-point communication system 328 and a target point-to-point communication system 329, in addition to other elements not shown, such as an array 300 of electromagnetic radiators 300R and a beam-narrowing architecture 301. The array 300 produces a first electromagnetic beam 317 which is converted to a last beam 319, having a certain direction 319*d*, traveling from the point-to-point communication system 328 to the target point-to-point communication system 329. FIG. 14A illustrates one state of this system, in which there is a successful communication link between the point-to-point communication system 328 and the target point-to-point communication system 329.

Figure 14B:
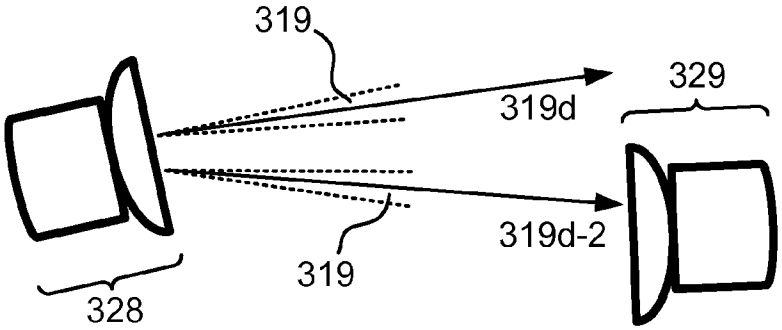
FIG. 14B illustrates one embodiment of a communication system, in which a beam-narrowing architecture belongs to a point-to-point communication system, the communication system has become off-target as a result of some change in the system, and the direction of the communication transmission has been altered such that the new direction is substantially on-target to the receiving station in the system.

FIG. 14B illustrates one embodiment of a communication system, in which a beam-narrowing architecture belongs to a point-to-point communication system, the communication system has become off-target as a result of some change in the system, and the direction of the communication transmission has been altered such that the new direction is substantially on-target to the target point-to-point communication system in the system. FIG. 14B shows a different state of the same system illustrated and discussed in regard to FIG. 14A. However, in FIG. 14B, something has occurred to make ineffective the communication link between the point-to-point communication system 328 and the target point-to-point communication system 329. Communication beams traveling in direction 319*d*, which were formerly in FIG. 14A effective, and now ineffective in FIG. 14B. The change in the state of the system may be due to changing environmental conditions, change in the system equipment or position whether man-made or due to malfunction, or some change in system requirements that simply makes the former link not sufficiently effective. In order to restore the link to an acceptable level, the bearing of final beam 319 must be changed from an original bearing 319*d* to a new bearing 319*d*-2. As shown in FIG. 14B, after the change in bearing of final beam 319, the point-to-point communication is substantially on target. Although not shown in FIG. 14B, the systems includes also an array 300 of electromagnetic radiators 300R which generate a first beam 317, and a beam-narrowing architecture which converts the first beam 317 to a final beam 319.

One embodiment is a system operative to direct electromagnetic beams. In one specific embodiment, the system includes an array 300 of electromagnetic radiators 300R, together operative to generate, toward a configurable direction 317*d*, a first electromagnetic beam 317 having a first beam-width 317W and consequently associated with a first antenna gain. Also in this specific embodiment, there is a beam-narrowing architecture 301, operative to narrow the first electromagnetic beam 317 and consequently convert the first electromagnetic beam 317 into a second electromagnetic beam 319 having a second beam-width 319W that is narrower than the first beam-width 317W. As a result of the narrower beam-width 319W, the second beam 319 has: (i) an association with a second antenna gain that is higher than the first antenna gain and (ii) a final bearing 319*d* that is consequent upon the configurable direction 317*d*. Also in this specific embodiment, the system is operative to control the final bearing 319*d* via the configurable direction 317*d*.

In a first alternative embodiment to the system just described, further the array 300 of electromagnetic radiators 300R is a phased-array, and this phased-array is operative to achieve, electronically, the configurable direction 317*d* of the first beam 317. Configurable direction 317*d* is also referred to as a first direction, which is configurable.

In a second alternative embodiment to the system described above, further the array 300 of electromagnetic radiators 300R is a millimeter-wave array, and the first electromagnetic beam 317 is a first millimeter-wave beam.

In a third alternative embodiment to the system described above, the beam-narrowing architecture 301 includes a beam-focusing element 302 that is operative to translate the first electromagnetic beam 317 into an intermediate beam 318 having a spatial position 318*sp* that consequent upon the configurable direction 317*d* of the first beam 317. Also in this embodiment, the beam-narrowing architecture 301 includes a beam-dispersing element 303 operative to modify the intermediate beam 318 into the second electromagnetic beam 319 having the final bearing 319*d* consequent upon the spatial position 318*sp*.

In a first variation of the third alternative embodiment described above, further the first electromagnetic beam 317 has a first electromagnetic polarity, the beam-focusing element 302 is a twist-reflector 302*tr*, and the beam-narrowing architecture 301 further includes a polarizing surface 304. Also in this embodiment, the polarizing surface 304 is operative to reflect the first electromagnetic beam 317 as a result of the first electromagnetic beam 317 having said first electromagnetic polarity. Also in this embodiment, the twist-reflector 302*tr* is operative to perform the translation of the first electromagnetic beam 317 into the intermediate beam 318, wherein the intermediate beam 318 has a second electromagnetic polarity that is orthogonal to the first electromagnetic polarity. Also in this embodiment, the polarizing surface 304 is further operative to pass-through the intermediate beam 318 as a result of the intermediate beam 318 having the second electromagnetic polarity.

In a first configuration of the variation just described, further the beam-dispersing element 303 is a beam-dispersing lens 303L.

In a second configuration of the variation described above, further, the twist-reflector 302*tr* is a twist reflect array 302*tr*A, wherein the twist reflect array 302*tr*A is operative to emulate a curvature of the twist-reflector 302*tr*.

In a second variation of the third alternative embodiment described above, further the beam-focusing element 302 is a beam-focusing lens 302L. In some alternative embodiments, in addition the beam-dispersing element 303 is a beam-dispersing lens 303L.

In a third variation of the third alternative embodiment described above, further the beam-focusing element 302 has a first focal point 302F, and the array 300 of electromagnetic radiators 300R is located substantially at the first focal point 302F. As a result of this location of the array 300, the intermediate beam 318 is a substantially parallel beam, which facilitates the translation of the first electromagnetic beam 317 into the intermediate beam 318 having a spatial position 318*sp* consequent upon the configurable direction 317*d* of the first beam 317.

In a fourth variation of the third alternative embodiment described above, there is further a transparent sheet 305 disposed between the beam-focusing element 302 and the beam-dispersing element 303, wherein the transparent sheet 305 is operative to affect at least one electromagnetic property of the intermediate beam 318 before the intermediate beam 318 is modified into the second electromagnetic beam 319. In one embodiment, the transparent sheet 305 is operative to affect a polarity of intermediate beam 318.

In a fourth alternative embodiment to the system described above, further the first electromagnetic beam 317 has a first electromagnetic polarity, and the beam-narrowing architecture 301 includes a twist-reflector 302*tr* and a polarizing surface 304. Also in this embodiment, the polarizing surface 304 is operative to reflect the first electromagnetic beam 317 as a result of the first electromagnetic beam 317 having the first electromagnetic polarity. Also in this embodiment, the twist-reflector 302*tr* is operative to perform the conversion into the second electromagnetic beam 319, with a resulting second electromagnetic beam 319 having a second electromagnetic polarity that is orthogonal to the first electromagnetic polarity. Also in this embodiment, the polarizing surface 304 is further operative to pass-through the second electromagnetic beam 319 as a result of the second electromagnetic beam 319 having the second electromagnetic polarity.

In a variation of the fourth alternative embodiment just described, further the twist-reflector 302*tr* has a first focal point 302*tr*F, and the array 300 of electromagnetic radiators 300R is located off the first focal-point 302*tr*F, thereby facilitating the second beam-width 319W being narrower than said first beam-width 317W, and further facilitating the final direction 319*d* of the final beam 319 being consequent upon the configurable direction 317*d*.

In a fifth alternative embodiment to the system described above, further the beam-narrowing architecture 301 has an effective focal-point 301F, and the array 300 of electromagnetic radiators 300R is located off the effective focal-point 301F, thereby facilitating the second beam-width 319W being narrower than the first beam-width 317W, and further facilitating the final direction 319*d* of final beam 319 being consequent upon the configurable direction 317*d* of first beam 317.

In a sixth alternative embodiment to the system described above, further the configurable direction 317*d* of the first beam 317 is associated with a first angular scanning span 317*sc*, and the final direction 319*d* of the final beam 319 is associated with a second angular span 319*sc* that is narrower than the first angular scanning span 317*sc* as a result of the narrowing of the beam from the beam-width 317W of the first electromagnetic beam 317 to the beam-width 319W of the final electromagnetic beam 319.

Figure 15:
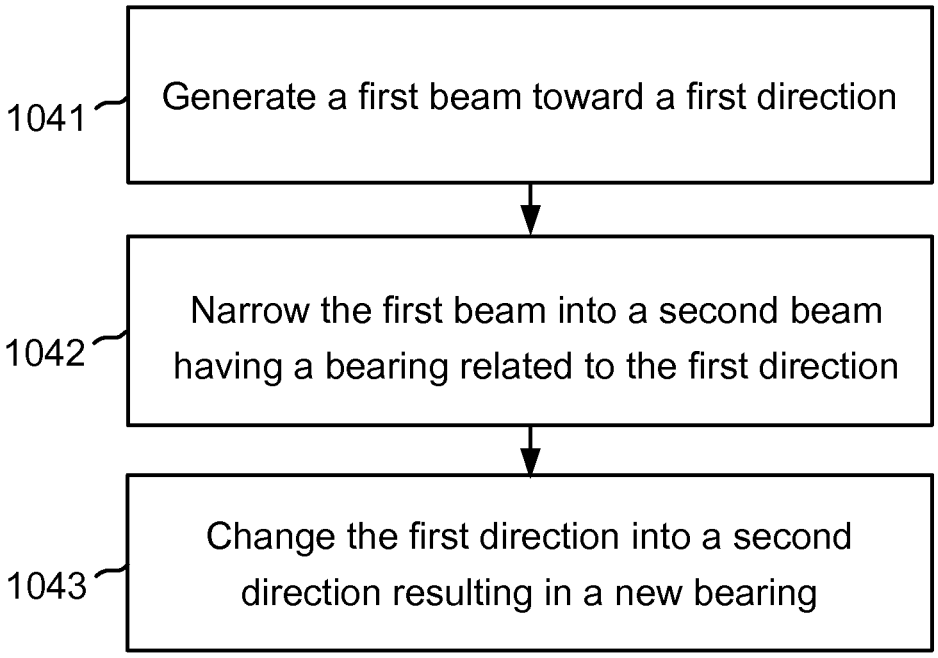
FIG. 15 illustrates one embodiment of a method for accurately controlling bearings of electromagnetic beams in a communication system.

FIG. 15 illustrates one embodiment of a method by which a wireless communication system may control accurately the bearings of electromagnetic beams. In step 1041: an array 300 of electromagnetic radiators in a communication system generates a first electromagnetic beam 317 toward a first direction 317*d*. In step 1042: a beam-narrowing architecture 301 narrows the first electromagnetic beam 317, resulting in a second electromagnetic beam 319 that has a bearing 319*d* that is consequent upon the first direction 317*d* of the first beam 317. In step 1043: the array 300 of electromagnetic radiators 300R changes the direction of the first electromagnetic beam 317 from a first direction 317*d* to a second direction 317*d*-2, thereby altering the bearing of the second electromagnetic beam 319 from said bearing 319*d* into a new bearing 319*d*-2 consequent upon the second direction 317*d*-2 of the first electromagnetic beam 317. Also in this specific embodiment, as a result of the narrowing procedure of the prior steps, a first angular difference 317delta between the first direction 317*d* and the second direction 317*d*-2 is substantially larger than a second angular difference 319delta between the first bearing 319*d* and the new bearing 319*d*-2 of the second beam 319. The fact that the angular difference 317delta of the first beam 317 is much larger than the angular difference 319delta of the second beam 319 facilitates accurate control over the new bearing 319*d*-2 of the second beam.

In a first alternative embodiment to the method just described, the array 300 of electromagnetic radiators 300R and the beam-narrowing architecture 301 are part of a wireless point-to-point communication transmitting system 328. Further, transmitting by the wireless point-to-point communication system 328, and via the first electromagnetic beam 317 and the second electromagnetic beam 319, a first transmission to be received by a target point-to-point communication system 329.

In a variation of the first alternative embodiment just described, further the point-to-point transmitting communication system 328 detects that the bearing 319*d* of the final beam 319 is off the target point-to-point communication system 329, so the wireless point-to-point communication system 328 triggers a direction changing procedure after which the new bearing 319*d*-2 of the final beam 319 is substantially on the target point-to-point communication system 329.

In a second alternative embodiment to the method described above, the first angular difference 317delta is greater than the second angular difference 319delta by a factor of at least 4 to 1, thereby facilitating accurate control over the new bearing 319*d*-2 of the second beam 319.

In a variation of the second alternative embodiment just described, the first electromagnetic beam 317 is associated with a first antenna gain of at least twelve (12) dBi, resulting in the second electromagnetic beam 319 being associated with a second antenna gain of at least twenty-four (24) dBi.

In this description, numerous specific details are set forth. However, the embodiments/cases of the invention may be practiced without some of these specific details. In other instances, well-known hardware, materials, structures and techniques have not been shown in detail in order not to obscure the understanding of this description. In this description, references to "one embodiment" and "one case" mean that the feature being referred to may be included in at least one embodiment/case of the invention. Moreover, separate references to "one embodiment", "some embodiments", "one case", or "some cases" in this description do not necessarily refer to the same embodiment/case. Illustrated embodiments/cases are not mutually exclusive, unless so stated and except as will be readily apparent to those of ordinary skill in the art. Thus, the invention may include any variety of combinations and/or integrations of the features of the embodiments/cases described herein. Also herein, flow diagrams illustrate non-limiting embodiment/case examples of the methods, and block diagrams illustrate non-limiting embodiment/case examples of the devices. Some operations in the flow diagrams may be described with reference to the embodiments/cases illustrated by the block diagrams. However, the methods of the flow diagrams could be performed by embodiments/cases of the invention other than those discussed with reference to the block diagrams, and embodiments/cases discussed with reference to the block diagrams could perform operations different from those discussed with reference to the flow diagrams. Moreover, although the flow diagrams may depict serial operations, certain embodiments/cases could perform certain operations in parallel and/or in different orders from those depicted. Moreover, the use of repeated reference numerals and/or letters in the text and/or drawings is for the purpose of simplicity and clarity and does not in itself dictate a relationship between the various embodiments/cases and/or configurations discussed. Furthermore, methods and mechanisms of the embodiments/cases will sometimes be described in singular form for clarity. However, some embodiments/cases may include multiple iterations of a method or multiple instantiations of a mechanism unless noted otherwise. For example, when a controller or an interface are disclosed in an embodiment/case, the scope of the embodiment/case is intended to also cover the use of multiple controllers or interfaces.

Certain features of the embodiments/cases, which may have been, for clarity, described in the context of separate embodiments/cases, may also be provided in various combinations in a single embodiment/case. Conversely, various features of the embodiments/cases, which may have been, for brevity, described in the context of a single embodiment/case, may also be provided separately or in any suitable sub-combination. The embodiments/cases are not limited in their applications to the details of the order or sequence of steps of operation of methods, or to details of implementation of devices, set in the description, drawings, or examples. In addition, individual blocks illustrated in the figures may be functional in nature and do not necessarily correspond to discrete hardware elements. While the methods disclosed herein have been described and shown with reference to particular steps performed in a particular order, it is understood that these steps may be combined, subdivided, or reordered to form an equivalent method without departing from the teachings of the embodiments/cases.

Accordingly, unless specifically indicated herein, the order and grouping of the steps is not a limitation of the embodiments/cases. Embodiments/cases described in conjunction with specific examples are presented by way of example, and not limitation. Moreover, it is evident that many alternatives, modifications and variations will be apparent to those skilled in the art. Accordingly, it is intended to embrace all such alternatives, modifications and variations that fall within the spirit and scope of the appended claims and their equivalents.

What is claimed is:

1. A system operative to direct electromagnetic beams, comprising:

an array of electromagnetic radiators together operative to generate, toward a configurable direction, a first electromagnetic beam having a first beam-width and consequently associated with a first antenna gain; and a beam-narrowing configuration, operative to narrow said first electromagnetic beam and consequently convert said first electromagnetic beam into a second electromagnetic beam having a second beam-width that is narrower than said first beam-width, resulting in said second electromagnetic beam having: (i) an association with a second antenna gain that is higher than said first antenna gain and (ii) a final bearing that is consequent upon said configurable direction;

whereas said system is operative to control said final bearing via said configurable direction.

2. The system of claim 1, wherein said array of electromagnetic radiators is a phased-array operative to achieve said configurable direction electronically.

3. The system of claim 1, wherein said array of electromagnetic radiators is a millimeter-wave array, and said first electromagnetic beam is a first millimeter-wave beam.

4. The system of claim 1, wherein said beam-narrowing configuration comprises:

a beam-focusing element operative to translate said first electromagnetic beam into an intermediate beam having a spatial position consequent upon said configurable direction; and a beam-dispersing element operative to modify said intermediate beam into said second electromagnetic beam having said final bearing consequent upon said spatial position.

5. The system of claim 4, wherein: said first electromagnetic beam has a first electromagnetic polarity; said beam-focusing element is a twist-reflector;

said beam-narrowing configuration further comprises a polarizing surface;

said polarizing surface is operative to reflect said first electromagnetic beam as a result of said first electromagnetic beam having said first electromagnetic polarity;

said twist-reflector is operative to perform said translation of said first electromagnetic beam into said intermediate beam with a resulting said intermediate beam having a second electromagnetic polarity that is orthogonal to said first electromagnetic polarity; and said polarizing surface is further operative to pass-through said intermediate beam as a result of said intermediate beam having said second electromagnetic polarity.

6. The system of claim 5, wherein said beam-dispersing element is a beam-dispersing lens.

7. The system of claim 5, wherein said twist-reflector is a twist reflect array operative to emulate a curvature of the twist-reflector.

8. The system of claim 4, wherein said beam-focusing element is a beam-focusing lens and said beam-dispersing element is a beam-dispersing lens.

9. The system of claim 4, wherein said beam-focusing element has a first focal point, and said array of electromagnetic radiators is located substantially at said first focal point, resulting in said intermediate beam being a substantially parallel beam, thereby facilitating said translation of said first electromagnetic beam into said intermediate beam having a spatial position consequent upon said configurable direction.

10. The system of claim 4, further comprising a transparent sheet, disposed between said beam-focusing element and said beam-dispersing element, said transparent sheet operative to affect at least one electromagnetic property of said intermediate beam prior to said modification of said intermediate beam into said second electromagnetic beam.

11. The system of claim 1, wherein said first electromagnetic beam has a first electromagnetic polarity, said beam-narrowing configuration comprises a twist-reflector and a polarizing surface;

said polarizing surface is operative to reflect said first electromagnetic beam as a result of said first electromagnetic beam having said first electromagnetic polarity;

said twist-reflector is operative to perform said conversion into said second electromagnetic beam, with a resulting said second electromagnetic beam having a second electromagnetic polarity that is orthogonal to said first electromagnetic polarity; and said polarizing surface is further operative to pass-through said second electromagnetic beam as a result of said second electromagnetic beam having said second electromagnetic polarity.

12. The system of claim 11, wherein said twist-reflector has a first focal point, and said array of electromagnetic radiators is located off said first focal-point, thereby facilitating said second beam-width being narrower than said first beam-width, and further facilitating said final bearing being consequent upon said configurable direction.

13. The system of claim 1, wherein said beam-narrowing configuration has an effective focal-point, and said array of electromagnetic radiators is located off said effective focal-point, thereby facilitating said second beam-width being narrower than said first beam-width, and further facilitating said final bearing being consequent upon said configurable direction.

14. The system of claim 1, wherein said configurable direction is associated with a first angular scanning span, and said final bearing is associated with a second angular span that is narrower than said first angular scanning span, as a result of said narrowing of said first electromagnetic beam.

15. A method for directing electromagnetic beams, comprising:

generating, by an array of electromagnetic radiators, toward a configurable direction, a first electromagnetic beam having a first beam-width and consequently associated with a first antenna gain;

narrowing, by a beam-narrowing configuration, said first electromagnetic beam, and consequently converting said first electromagnetic beam into a second electromagnetic beam having a second beam-width that is narrower than said first beam-width, resulting in said second electromagnetic beam having: (i) an association with a second antenna gain that is higher than said first antenna gain and (ii) a final bearing that is consequent upon said configurable direction; and controlling said final bearing via said configurable direction.

16. The method of claim 15, wherein said array of electromagnetic radiators and said beam-narrowing configuration belong to a wireless point-to-point communication system, and further comprising: transmitting, by said wireless point-to-point communication system, via said first electromagnetic beam and second electromagnetic beam, a first transmission to be received by a target point-to-point communication system.

17. The method of claim 16, further comprising: triggering a changing procedure upon detecting, by said wireless point-to-point communication system, that said final bearing is off said target point-to-point communication system, whereas a new bearing is substantially on said target point-to-point communication system.

18. The method of claim 15, further comprising: changing, by said array of electromagnetic radiators, direction of said first electromagnetic beam from said configurable direction to a second direction, thereby altering direction of said second electromagnetic beam from a bearing into a new bearing consequent upon said second direction and affected by said narrowing; whereas, as a result of said narrowing, a first angular difference between said configurable direction and said second direction is substantially larger than a second angular difference between said bearing and said new bearing, thereby facilitating accurate control over said new bearing.

19. The method of claim 18, wherein said first angular difference is greater than said second angular difference by a factor of at least 4, thereby better facilitating said accurate control over said new bearing.

20. The method of claim 19, wherein said first electromagnetic beam is associated with a first antenna gain of at least twelve (12) dBi, resulting in said second electromagnetic beam being associated with a second antenna gain of at least twenty-four (24) dBi.

* * * * *